US010562724B2

(12) United States Patent
Kawamura et al.

(10) Patent No.: US 10,562,724 B2
(45) Date of Patent: Feb. 18, 2020

(54) IMAGE FORMING APPARATUS AND FEEDING APPARATUS

(71) Applicant: CANON KABUSHIKI KAISHA, Tokyo (JP)

(72) Inventors: Koji Kawamura, Yokohama (JP); Joji Goto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/995,919

(22) Filed: Jun. 1, 2018

(65) Prior Publication Data

US 2018/0275584 A1 Sep. 27, 2018

Related U.S. Application Data

(62) Division of application No. 15/495,585, filed on Apr. 24, 2017, now Pat. No. 10,294,053.

(30) Foreign Application Priority Data

Apr. 28, 2016 (JP) ..... 2016-091436
Jul. 27, 2016 (JP) ..... 2016-147494

(51) Int. Cl.
*B65H 7/12* (2006.01)
*B65H 3/06* (2006.01)
(Continued)

(52) U.S. Cl.
CPC ..... *B65H 7/125* (2013.01); *B65H 3/06* (2013.01); *B65H 7/02* (2013.01); *B65H 7/12* (2013.01);
(Continued)

(58) Field of Classification Search
CPC ..... B65H 7/20; B65H 3/06; B65H 2513/42; B65H 2513/511; B65H 2513/512;
(Continued)

(56) References Cited

U.S. PATENT DOCUMENTS 6,540,222 B2 4/2003 Araki
7,234,695 B2 6/2007 Tsukamoto
(Continued)

FOREIGN PATENT DOCUMENTS

JP 2002173234 A 6/2002
JP 3327857 B2 9/2002
(Continued)

*Primary Examiner* — Michael C McCullough
(74) *Attorney, Agent, or Firm* — Canon U.S.A., Inc. IP Division

(57) ABSTRACT

A feeding apparatus includes a feeding member, first and second conveying members, a separation member, and drive and control units. The feeding member feeds a recording material placed on a tray. The separation member and the first conveying member form a nip portion and separates recording materials at the nip portion. The second conveying member conveys a conveyed recording material. The drive unit drives at least the feeding member. The control unit controls to feed first and second recording materials such that a second recording material front edge passes the nip portion before a first recording material rear edge passes the nip portion, and controls to stop the second recording material after the second recording material front edge has passed the nip portion such that the first recording material rear edge reaches the second conveying member before the second recording material front edge reaches the second conveying member.

8 Claims, 31 Drawing Sheets

(51) Int. Cl.
*B65H 7/02* (2006.01)
*G03G 15/00* (2006.01)
*B65H 7/20* (2006.01)

(52) U.S. Cl.
CPC ..... *B65H 7/20* (2013.01); *G03G 15/6502* (2013.01); *G03G 15/6511* (2013.01); *B65H 2511/13* (2013.01); *B65H 2513/50* (2013.01); *B65H 2513/512* (2013.01); *B65H 2513/514* (2013.01); *B65H 2601/521* (2013.01); *B65H 2801/03* (2013.01)

(58) Field of Classification Search
CPC ... B65H 2513/514; G03G 2215/00556; G03G 2215/00599
USPC ..... 271/4.03, 10.03
See application file for complete search history.

(56) References Cited

U.S. PATENT DOCUMENTS

| | | | | |
|---|---|---|---|---|
| 7,392,980 | B2 | 7/2008 | Takeuchi | |
| 7,481,421 | B2 | 1/2009 | Tsukamoto | |
| 7,591,460 | B2 | 9/2009 | Ohshima | |
| 8,444,135 | B2 * | 5/2013 | Morita | B65H 7/14 271/265.01 |
| 8,585,050 | B2 | 11/2013 | Syracuse | |
| 8,636,275 | B2 * | 1/2014 | Kambayashi | B65H 3/0684 271/117 |
| 10,106,352 | B2 | 10/2018 | Gillier | |
| 10,189,662 | B2 | 1/2019 | Okano | |
| 10,294,053 | B2 | 5/2019 | Kawamura | |
| 2007/0236553 | A1 * | 10/2007 | Kawano | G03G 15/326 347/133 |
| 2008/0277860 | A1 | 11/2008 | Chen | |
| 2012/0119436 | A1 * | 5/2012 | Morita | B65H 7/14 271/259 |
| 2013/0001852 | A1 | 1/2013 | Ogasawara | |
| 2016/0124687 | A1 * | 5/2016 | Shinagawa | G06F 3/1211 347/16 |
| 2019/0127166 | A1 | 5/2019 | Ochi | |

FOREIGN PATENT DOCUMENTS

| | | | |
|---|---|---|---|
| JP | 3359295 | B2 | 12/2002 |
| JP | 2007001759 | A | 1/2007 |
| JP | 2010001137 | A | 1/2010 |

* cited by examiner

FIG. 17A−1
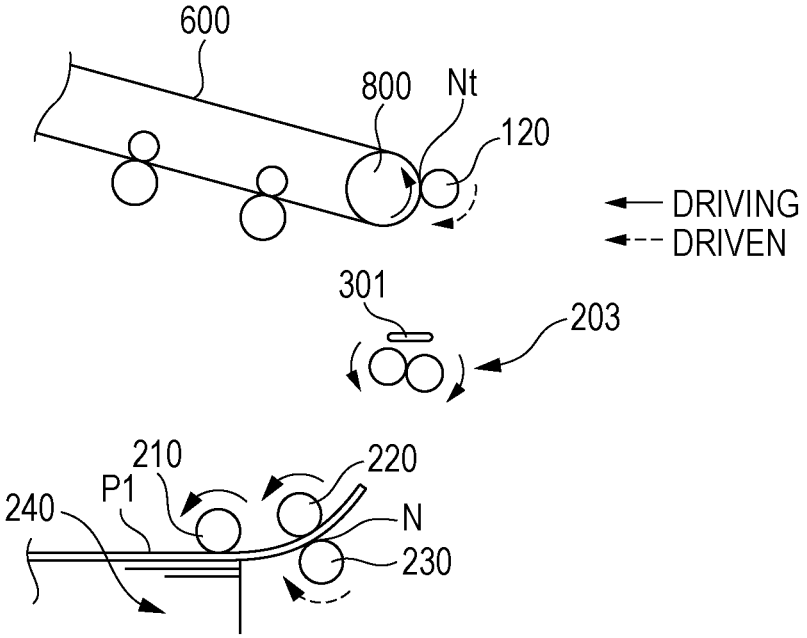
FIG. 17A−2
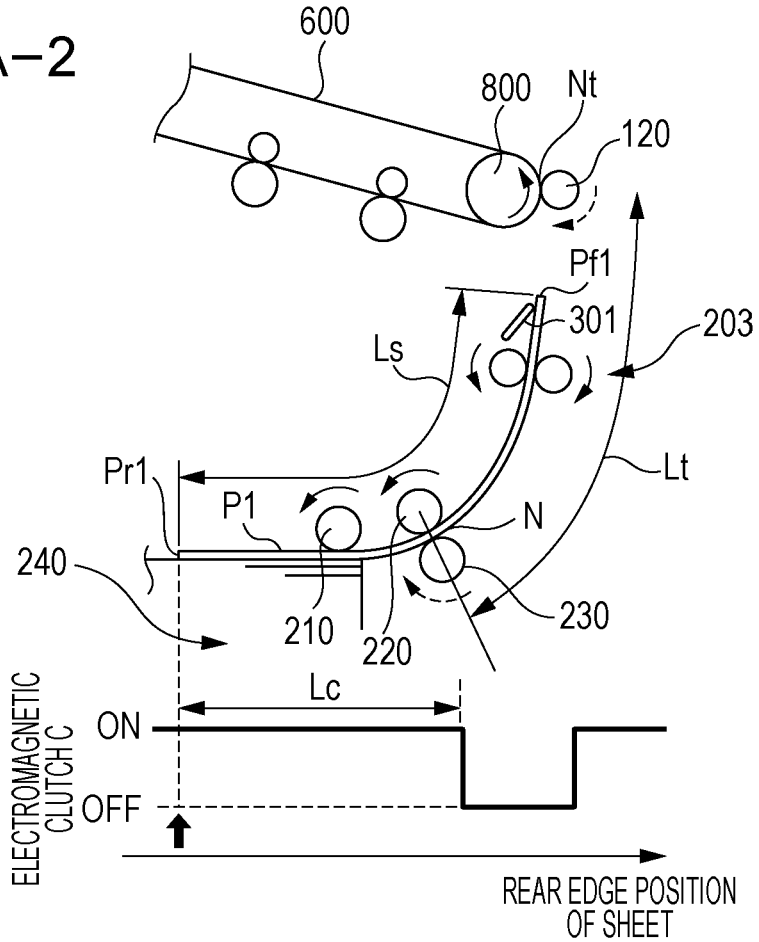

FIG. 17B−1
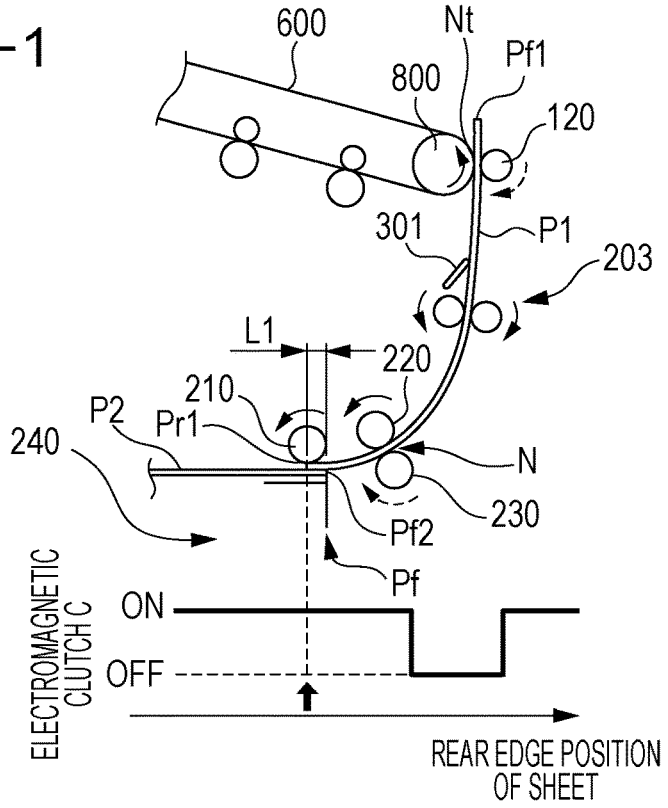
FIG. 17B−2
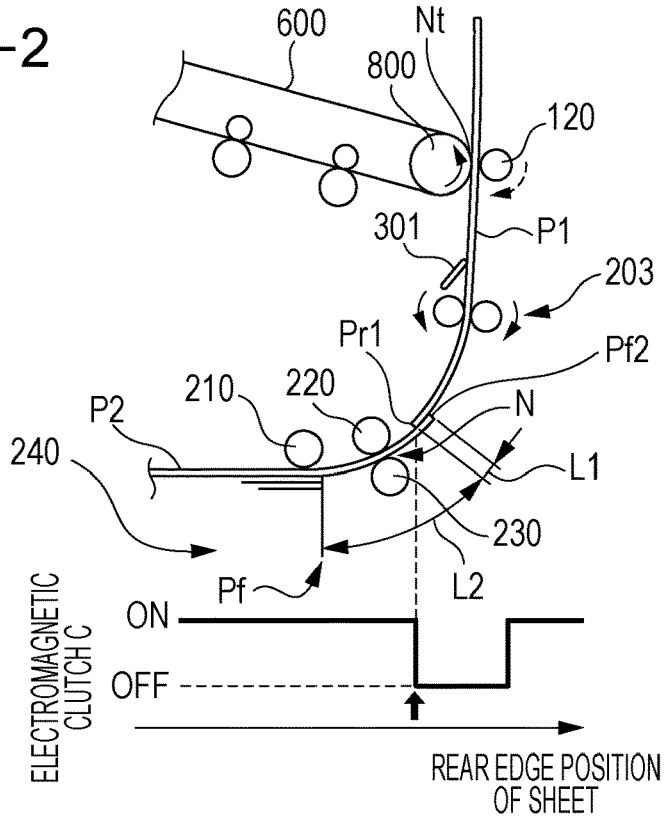

FIG. 17C−1
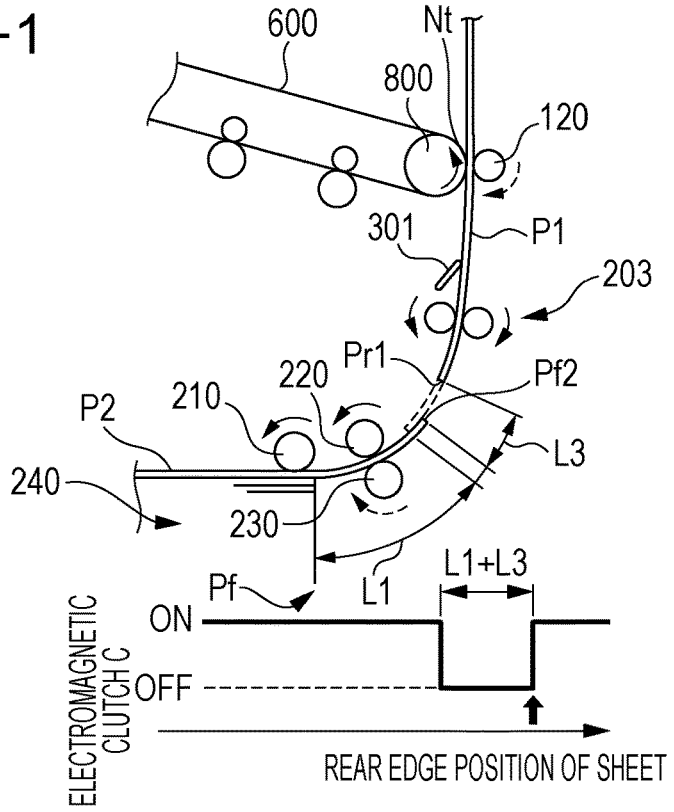
FIG. 17C−2
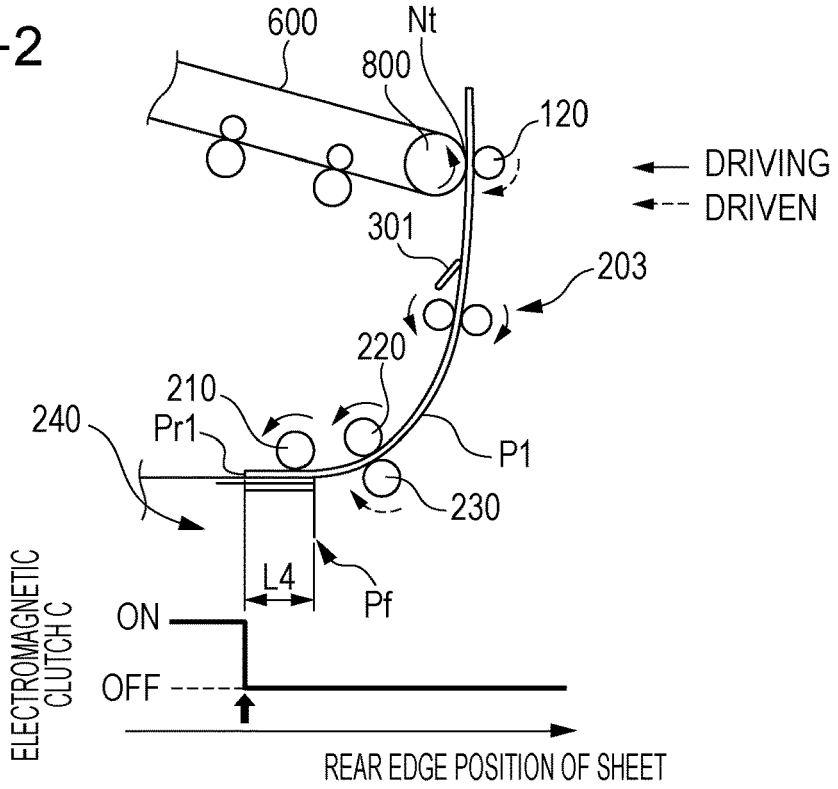

IMAGE FORMING APPARATUS AND FEEDING APPARATUS

CROSS REFERENCE TO RELATED APPLICATIONS

This application is a divisional of U.S. patent application Ser. No. 15/495,585, filed on Apr. 24, 2017, which claims priority from Japanese Patent Application No. 2016-147494, filed Jul. 27, 2016, and from Japanese Patent Application No. 2016-091436, filed Apr. 28, 2016, all of which are hereby incorporated by reference herein in their entirety.

BACKGROUND OF THE INVENTION

Field of the Invention

The present disclosure relates to image forming apparatuses, such as a copier and a printer, and to feed control of a recording material in a feeding apparatus used in the image forming apparatuses.

Description of the Related Art

Conventional image forming apparatuses, such as a copier and a printer, include a feeding apparatus that feeds sheets placed (stacked) on a cassette, such as a tray (a stack portion), towards a conveyance roller on the downstream side. A feeding apparatus described in Japanese Patent Laid-Open No. 10-167494 feeds out a sheet placed on a tray with a pickup roller. In such a case, when a plurality of sheets are fed out due to friction, the plurality of sheets are separated sheet by sheet into a preceding sheet and a succeeding sheet with the feed roller and the separation roller. In the above feeding apparatus, when the preceding sheet reaches a conveyance roller downstream of the feed roller, driving of the pickup roller and the feed roller is stopped, and the preceding sheet is pulled out with the conveyance roller. With the above, the succeeding sheet is prevented from being fed downstream a separation nip portion formed by the feed roller and the separation roller.

Note that in a state in which driving of the pickup roller and the feed roller is stopped and in which the preceding sheet is pulled out by the conveyance roller, there is a load (hereinafter, referred to as back tension) on the preceding sheet. Furthermore, when a rear edge of the preceding sheet passes through the separation nip portion, there will be no more back tension on the preceding sheet; accordingly, the conveyance speed of the preceding sheet becomes instantaneously fast. Due to the above, issues such as generation of a snapping sound and occurrence of an image defect occurs.

SUMMARY OF THE INVENTION

The present disclosure provides an image forming apparatus and a feeding apparatus that are capable of reducing the effect of the back tension created when a rear edge of a recording material passes through a separation nip portion.

According to an aspect of the present disclosure, a feeding apparatus includes a feeding member that feeds a recording material placed on a tray, a first conveying member that conveys the recording material that has been fed by the feeding member, a separation member that forms a nip portion together with the first conveying member and that separates a plurality of the recording materials from each other at the nip portion, a second conveying member that conveys the recording material that has been conveyed by the first conveying member, a drive unit that drives at least the feeding member, and a control unit that controls the drive unit to feed, with the feeding member, a first recording material placed on the tray, and to feed, with the feeding member, a second recording material placed on the tray such that a front edge of the second recording material passes the nip portion before a rear edge of the first recording material passes the nip portion, and that controls the drive unit to stop the second recording material after the front edge of the second recording material has passed the nip portion such that the rear edge of the first recording material reaches the second conveying member before the front edge of the second recording material reaches the second conveying member.

Further features of the present invention will become apparent from the following description of embodiments with reference to the attached drawings.

BRIEF DESCRIPTION OF THE DRAWINGS

FIGS. 17A-1 and 17A-2 are cross-sectional views illustrating a sheet conveyance operation of the fifth embodiment.

FIGS. 17B-1 and 17B-2 are cross-sectional views illustrating a sheet conveyance operation of the fifth embodiment.

FIGS. 17C-1 and 17C-2 are cross-sectional views illustrating a sheet conveyance operation of the fifth embodiment.

DESCRIPTION OF THE EMBODIMENTS

First Embodiment

An issue addressed by the first to fourth embodiments will be described in detail.

Figure 14A:
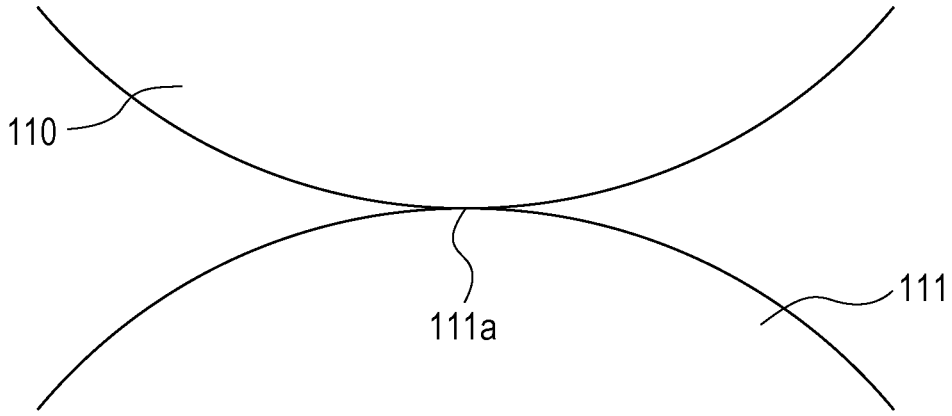
FIGS. 14A and 14B are diagrams for describing an issue of the related art.
Figure 14B:
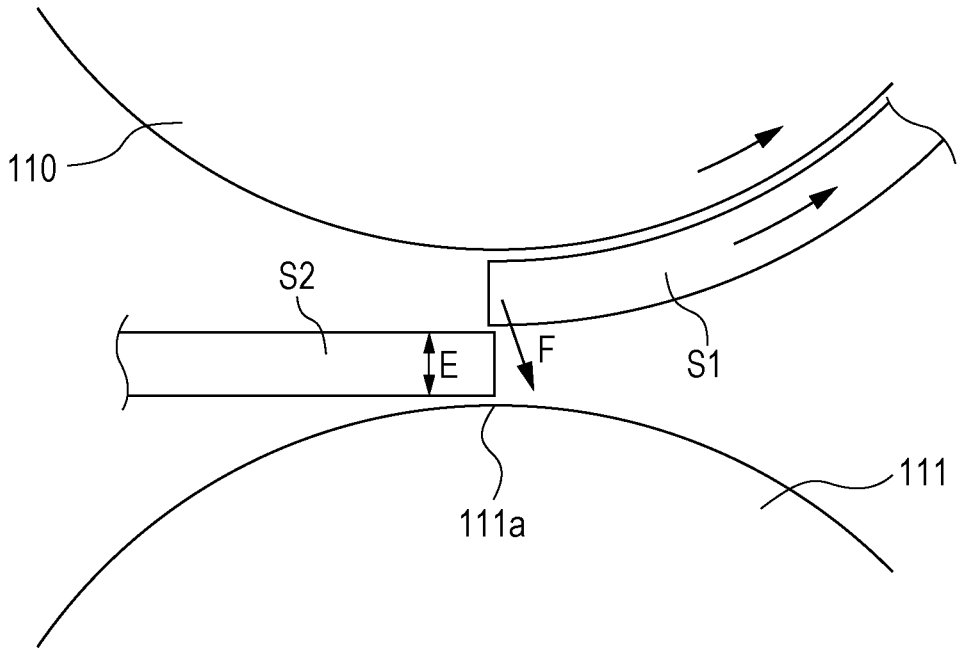

FIG. 14A is a diagram for describing an issue in the related art, and illustrates an enlarged view of a separation nip portion 111*a* formed between a feed roller 110 and a separation roller 111. In a case in which a succeeding sheet S2 is fed out together with a preceding sheet S1 such that two sheets are fed to the separation nip portion 111*a*, owing to a control of the related art, the succeeding sheet S2 is not fed downstream of the separation nip portion 111*a*. Note that the control of the related art is, as described above, a control in which drive of a pickup roller and drive of a feed roller are stopped and the preceding sheet S1 is pulled out with a conveyance roller positioned downstream. However, as illustrated in FIG. 14B, there are cases in which the succeeding sheet S2 proceeds to the vicinity of the separation nip portion 111*a*. In such a state, when a rear edge of the preceding sheet S1 passes through the separation nip portion 111*a*, a snapping sound is generated by the rear edge of the preceding sheet S1 jerking in an arrow F direction due to a step created by a thickness E of the succeeding sheet S2.

The first to fourth embodiments provide a feeding apparatus that reduces the snapping sound created when the rear edge of the recording material passes through the separation nip portion.

Configuration

Hereinafter, embodiments will be described while referring to the drawings. Note that elements that are common among the drawings will be denoted with the same reference numerals.

Figure 1:
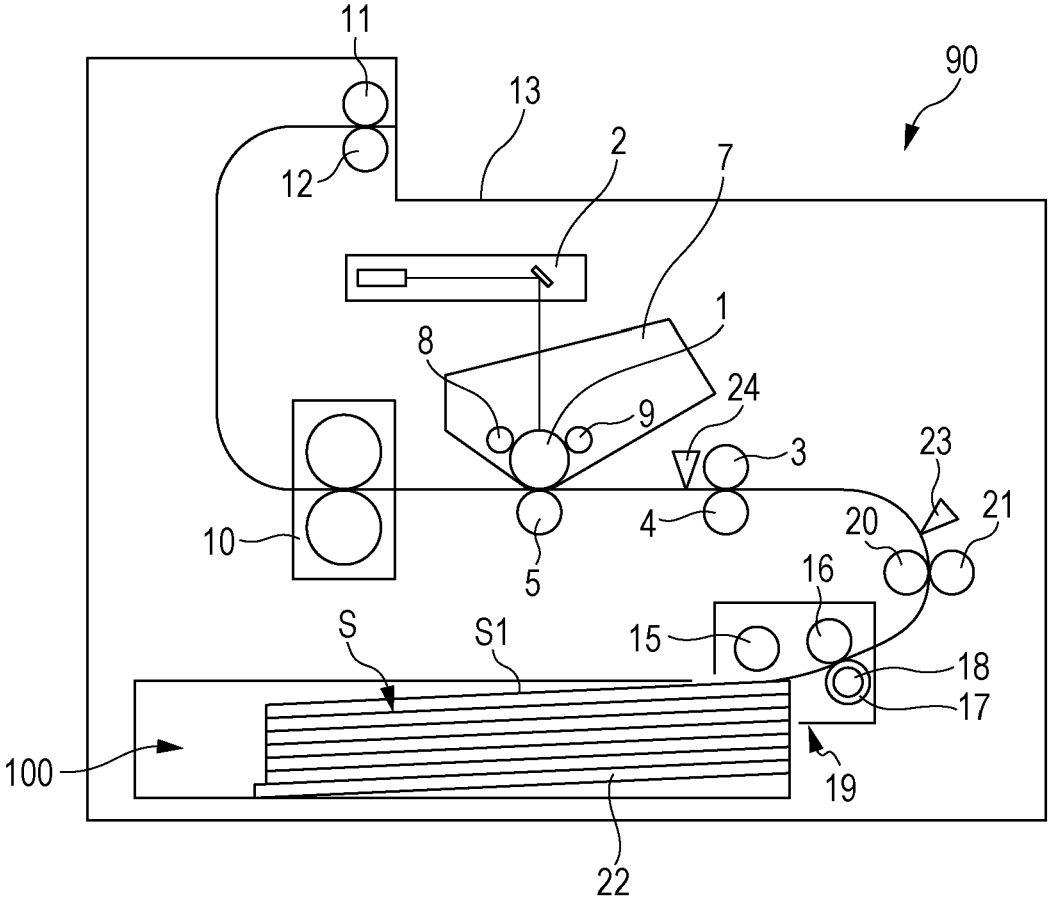
FIG. 1 is a cross-sectional view of a printer according to a first embodiment.

FIG. 1 is a cross-sectional view schematically illustrating a laser beam printer 90 (hereinafter, referred to as a printer 90) that is an example of an image forming apparatus provided with a feeding apparatus according to the first embodiment.

In FIG. 1, the printer 90 includes a photosensitive drum 1, serving as an image carrying member, inside a cartridge 7. A charging roller 8 charges a surface of the photosensitive drum 1. A scanner unit 2 projects a laser beam onto the photosensitive drum 1 according to image information and forms an electrostatic latent image on the photosensitive drum 1. A developing roller 9 using toner visualizes the electrostatic latent image formed on the photosensitive drum 1. The toner image formed on the photosensitive drum 1 is transferred onto a sheet S, serving as a recording material, with a transfer roller 5. The above process members function as an image forming unit that forms an image on the sheet S.

The feeding apparatus includes a cassette 100 and a roller unit 19. A sheet stacking plate 22 that is a tray (a stack portion) on which a plurality of sheets S are placed (stacked) is provided in the cassette 100. In a stand-by state, the sheets S are lifted up to a feed-out position with the sheet stacking plate 22, and the sheet S1 at the uppermost position is in contact with a pickup roller 15 (a feeding member, hereinafter, referred to as a pick roller 15). Upon input of a print signal, the pick roller 15 feeds the sheet S1 from the sheets S stacked on the sheet stacking plate 22. A feed roller 16 (a first conveying member) feeds the sheet S1, which has been fed by the pick roller 15, further downstream. A separation roller 17 (separation member) is fixed to a chassis or the like of the printer 90 with a torque limiter 18 in between. Details of an operation of the separation roller 17 will be described later.

The sheet S1 that has been fed with the feed roller 16 is conveyed by a pair of pulling-out rollers 20 and 21 (second conveying members) and a pair of registration rollers 3 and 4 (second conveying members). A conveyance sensor 23 and a registration sensor 24 (detection units) detect the conveyed sheet S1. The transfer roller 5 described above transfers the toner image onto the sheet S1 that has been conveyed by the pair of registration rollers 3 and 4. Subsequently, a fixing unit 10 fixes, with heat and pressure, the toner image transferred to the sheet S1 to the sheet S1. The sheet S1 on which the toner image has been fixed is discharged onto a sheet discharge tray 13 with a pair of discharge rollers 11 and 12.

Figure 2:
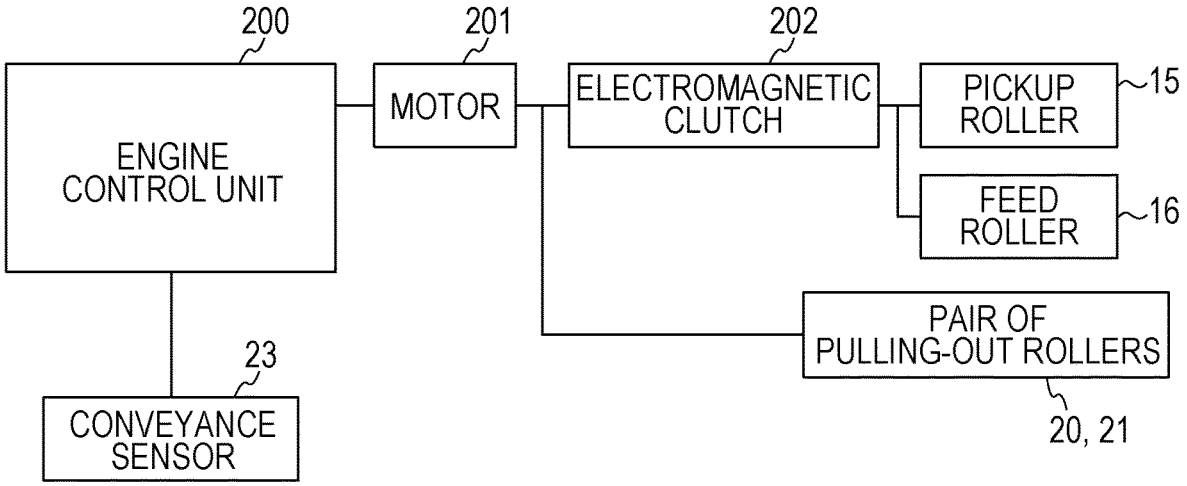
FIG. 2 is a control block diagram of the printer according to the first embodiment.

FIG. 2 is a control block diagram of the printer 90 according to the present embodiment. An engine control unit 200 that controls the operation of the printer 90 includes therein a CPU, a ROM, a RAM, and the like, and executes a process based on a program that is pre-stored in the ROM. A motor 201 serving as a drive unit is connected to the engine control unit 200. The motor 201 drives and rotates the pick roller 15 and the feed roller 16 through an electromagnetic clutch 202. A one way clutch (not shown) is built-in inside each of the pick roller 15 and the feed roller 16 such that when the electromagnetic clutch 202 is turned off, the pick roller 15 and the feed roller 16 are capable of only rotating in the direction in which the sheet S is fed. Furthermore, the motor 201 drives and rotates the pair of pulling-out rollers 20 and 21. Furthermore, a detection result of the conveyance sensor 23 is communicated to the engine control unit 200.

Operation

Figure 3:
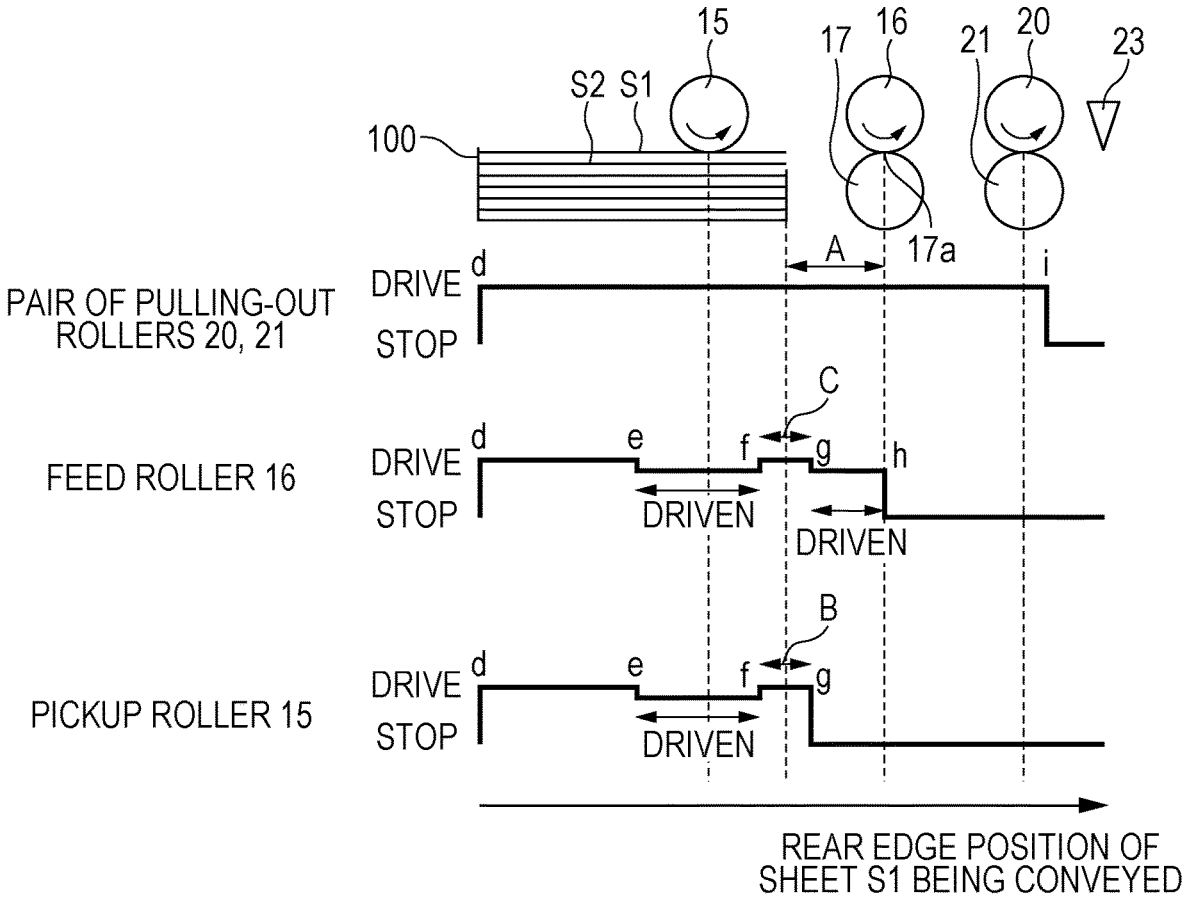
FIG. 3 is a timing chart of a sheet feeding control according to the first embodiment.

Referring to FIG. 3, a feed operation of the present embodiment will be described in detail. FIG. 3 is a timing chart of the control during feeding, and is a diagram schematically illustrating positional relationships between a rear edge position of the sheet S1 and the rollers during feeding. Note that the rear edge of the sheet S1 is an edge of the sheet S1 on the upstream side in the feeding direction.

Upon input of a print signal, the engine control unit 200 rotates the pair of pulling-out rollers 20 and 21 with the motor 201. At substantially the same time, the engine control unit 200 turns the electromagnetic clutch 202 on and rotates the pick roller 15 and the feed roller 16 (a timing at which the rear edge of the sheet S1 is at position d in FIG. 3).

The sheet S1 that has been fed out by the pick roller 15 passes through a separation nip portion 17*a* formed between the feed roller 16 and the separation roller 17, and reaches the pair of pulling-out rollers 20 and 21. The engine control unit 200 turns the electromagnetic clutch 202 off when the front edge of the sheet S1 reaches the pair of pulling-out rollers 20 and 21. In the above, the rear edge of the sheet S1 has not passed through the pick roller 15 (a timing at which the rear edge of the sheet S1 is at position e in FIG. 3).

The pair of pulling-out rollers 20 and 21 pulling out the sheet S1 from the separation nip portion 17*a* conveys the sheet S1 downstream. In so doing, since the electromagnetic clutch 202 is off, no driving force from the motor 201 is transmitted to the pick roller 15 and the feed roller 16. However, upon conveyance of the sheet S1, the two rollers are driven by the one way clutches.

Subsequently, at a timing after a predetermined time has passed since the rear edge of the sheet S1 has passed through the pick roller 15, the engine control unit 200 turns the electromagnetic clutch 202 on again (a timing at which the rear edge of the sheet S1 is at position f in FIG. 3).

The electromagnetic clutch 202 is turned on again and the pick roller 15 and the feed roller 16 rotate. In so doing, since the sheet S1 has already passed through the pick roller 15, the sheet S2 that is fed after the sheet S1 comes in contact with the pick roller 15 and is fed. Subsequently, the engine control unit 200 turns the electromagnetic clutch 202 off again at a timing at which the sheet S2 has been conveyed a predetermined distance B by the pick roller 15. In the above, the sheet S1 also is conveyed a predetermined distance C (=B) by the feed roller 16 and the pair of pulling-out rollers 20 and 21 (a timing at which the rear edge of the sheet S1 is at position g in FIG. 3). Note that due to the configuration of the drive train, drive is transmitted to the feed roller 16 as well during pre-feeding of the sheet S2 and the sheet S1 is conveyed over a distance C; however, there is no issue in not transmitting the drive to the feed roller 16.

After the end of the sheet S2 pre-feeding operation, the feed roller 16 is driven by the sheet S1 until the rear edge of the sheet S1 passes through the separation nip portion 17*a*, and stops subsequently (a timing at which the rear edge of the sheet S1 is at position h in FIG. 3). Meanwhile, since the sheet S2 in contact with the pick roller 15 is conveyed only the predetermined distance B, the sheet S2 has not reached the pair of pulling-out rollers 20 and 21. Accordingly, in a state in which the electromagnetic clutch 202 is off, the sheet S2 is at a stop. In other words, the pick roller 15 is not driven by the sheet S2 and is at a stop.

After the rear edge of the sheet S1 has passed through the separation nip portion 17*a* and, further, at a timing at which the rear edge of the sheet S1 passes through the pair of pulling-out rollers 20 and 21, the engine control unit 200 stops the motor 201 (at a timing at which the rear edge of the sheet S1 is at position i in FIG. 3). With the above, the feed operation of the sheet S1 is ended.

The timing at which the sheet S2 pre-feeding operation is started (f in FIG. 3) and the timing at which the sheet pre-feeding operation is ended (g in FIG. 3) are calculated by the engine control unit 200 based on the timing in which the sheet S1 has reached the conveyance sensor 23. Considering the length of the sheet S1 and the conveyance speed of the sheet S1, the engine control unit 200 calculates the above timings. Furthermore, since there is a delay until the pick roller 15 rotates after the electromagnetic clutch 202 is turned on due to the gaps in the drive train (not shown), the engine control unit 200 calculates the timings while considering the above delay as well.

Note that the timing at which the sheet pre-feeding operation is started or ended may be calculated based on the timing at which the sheet S1 reaches the registration sensor 24, rather than the timing at which the sheet S1 reaches the conveyance sensor 23. Alternatively, the timing may be calculated based on the timing at which the pick roller 15 and the feed roller 16 start feeding the sheet S1 stacked on the cassette 100.

Furthermore, in a case in which a plurality of sheets S are continuously fed, the motor 201 may be rotated continuously and the electromagnetic clutch 202 may be repeatedly turned on and off.

Figure 4:
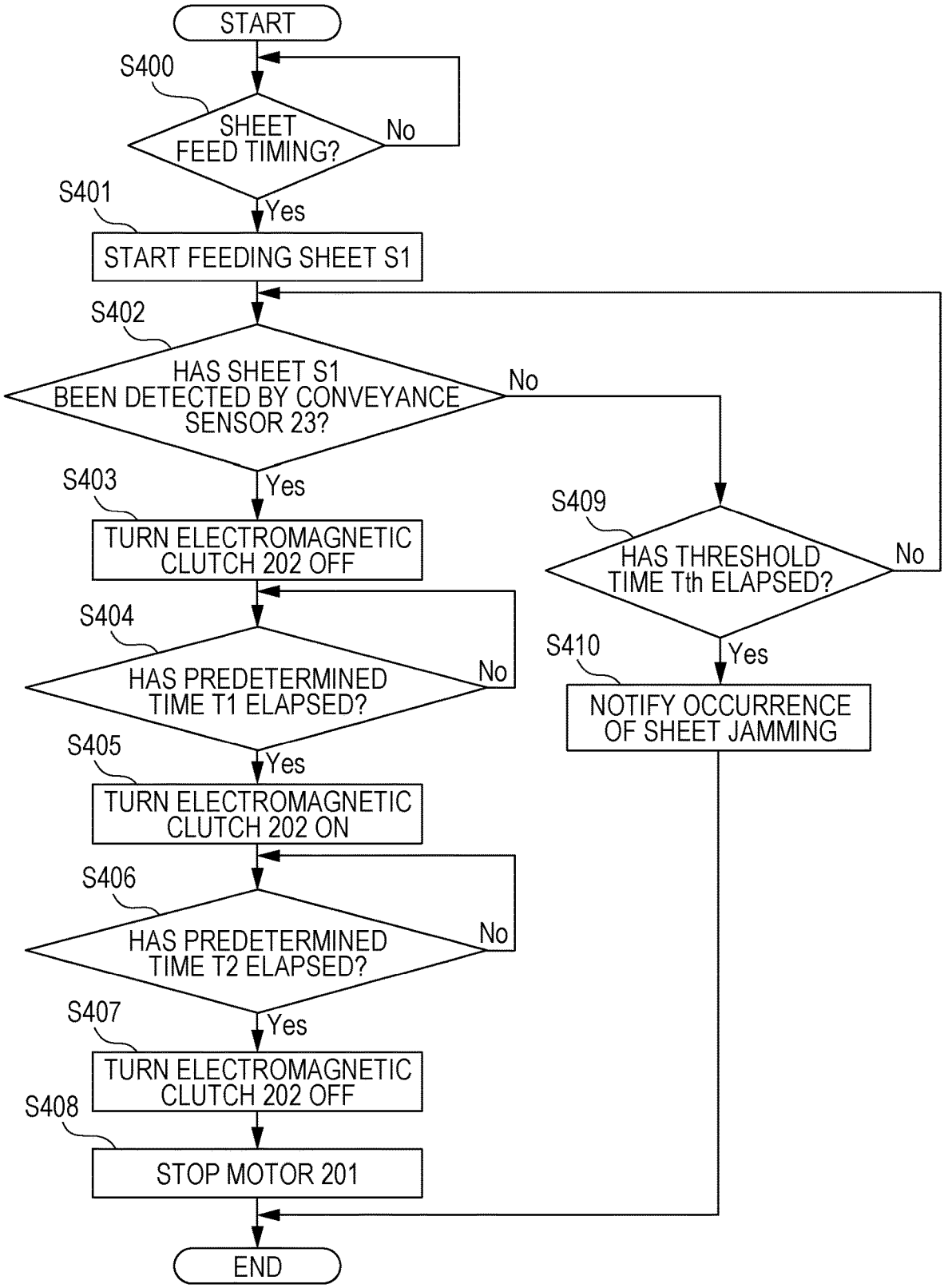
FIG. 4 is a flowchart of the sheet feeding control according to the first embodiment.

A flowchart summarizing the above feed operation is illustrated in FIG. 4. The control based on the flowchart in FIG. 4 is executed by the engine control unit 200 based on a program stored in the ROM and the like.

First, the engine control unit 200 receiving a print command determines whether it is a timing to feed the sheet S from the cassette 100 (S400). When determined that it is a timing to feed the sheet S, the engine control unit 200 starts the sheet S1 feeding operation (S401). Specifically, as described above, the motor 201 is driven, and the electromagnetic clutch 202 is turned on. With the above, the pick roller 15, the feed roller 16, and the pair of pulling-out rollers 20 and 21 are rotated.

Subsequently, the engine control unit 200 determines whether the conveyance sensor 23 has detected the sheet S1 (S402). When determined that the sheet S1 has been detected by the conveyance sensor 23, the engine control unit 200 turns the electromagnetic clutch 202 off (S403). With the above, the sheet S1 is conveyed by the pair of pulling-out rollers 20 and 21, and upon conveyance of the sheet S1, the pick roller 15 and the feed roller 16 are driven.

Subsequently, the engine control unit 200 determines whether it is a timing at which at least the rear edge of the sheet S1 has passed the pick roller 15, in other words, the engine control unit 200 determines whether it is a timing at which a predetermined time T1 has passed from when the conveyance sensor 23 has detected the sheet S1 (S404). When determined that it is a timing at which the predetermined time T1 has passed, the engine control unit 200 turns the electromagnetic clutch 202 on to start the sheet S2 pre-feeding operation (S405).

Subsequently, the engine control unit 200 determines whether it is a timing at which the sheet S2 has been conveyed the predetermined distance B, in other words, the engine control unit 200 determines whether it is a timing at which a predetermined time T2 has passed from when the conveyance sensor 23 has detected the sheet S1 (S406). When determined that it is a timing at which the predetermined time T2 has passed, the engine control unit 200 turns the electromagnetic clutch 202 off to end the sheet S2 pre-feeding operation (S407). After the conveyance of the sheet S1 is completed, the engine control unit 200 stops the motor 201 (S408).

On the other hand, in S402, when it is determined that the conveyance sensor 23 has not detected the sheet S1, the engine control unit 200 determines whether it is a timing at which a threshold time Tth has passed from after the sheet S1 feeding operation has been started (S409). Note that the threshold time Tth is a time period that is at least longer than the predetermined time T1. When determined that it is a timing at which the threshold time Tth has passed, the engine control unit 200 displays, on an operation panel (not shown) provided in the printer 90, a message that a sheet jamming has occurred (S410). With the above, the control in the present flowchart ends.

Figure 5A:
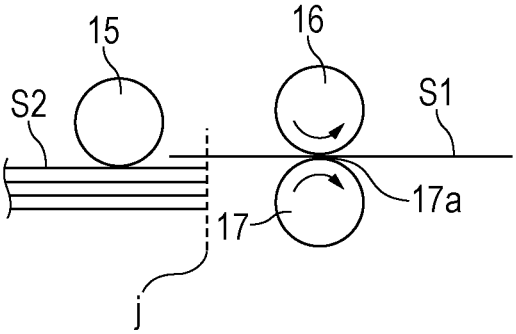
FIGS. 5A to 5F are diagrams for describing movements of the sheets according to the first embodiment.
Figure 5D:
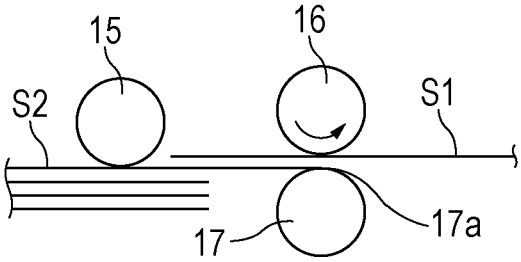
Figure 5B:
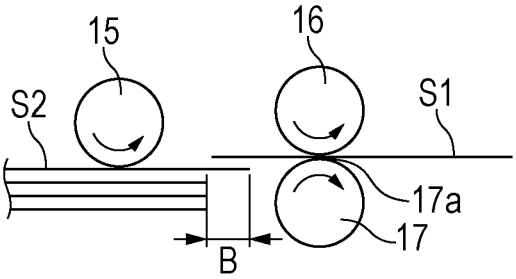
Figure 5E:
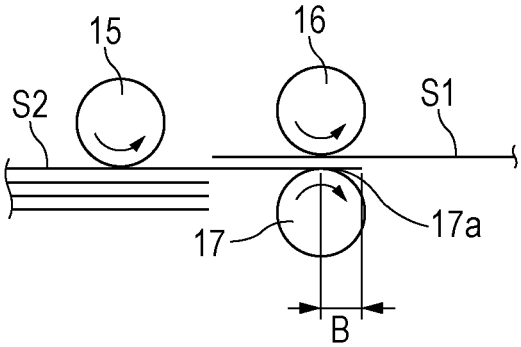
Figure 5C:
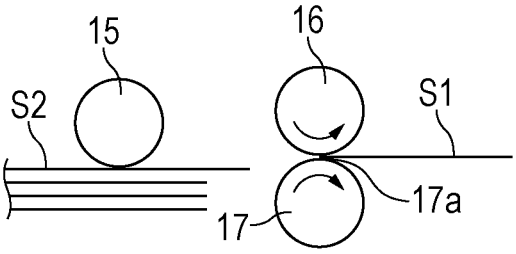

Referring to FIGS. 5A to 5F, the motion of the sheet S caused by the feed control described above will be described next. FIG. 5A illustrates a state at a time when the fed sheet S1 is passed through the pick roller 15 in which the succeeding sheet S2 is not moving forward from a sheet setting position j. In other words, a state in which there is no sheet fed out together with another sheet is illustrated. In such a case, as illustrated in FIG. 5B, the succeeding sheet S2 is conveyed the predetermined distance B with the sheet S2 pre-feeding operation. Subsequently, as illustrated in FIG. 5C, the fed sheet S1 passes through the separation nip portion 17*a*. In so doing, since a front edge of the succeeding sheet S2 (an edge on the downstream side in the feeding direction) is positioned upstream of the separation nip portion 17*a*, a large snapping sound does not occur when the fed sheet S1 passes through the separation nip portion 17*a*.

Figure 5F:
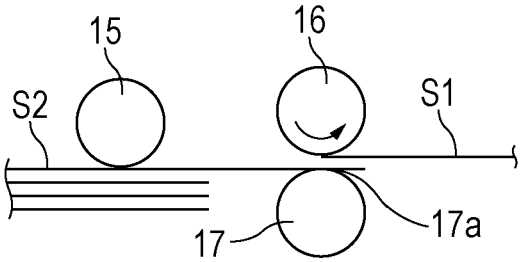

FIG. 5D illustrates a state in which the succeeding sheet S2 has moved forward to the separation nip portion 17*a* at a time when the fed sheet S1 is passed through the pick roller 15. In other words, FIG. 5D illustrates a state in which the sheet S2, due to the friction with the sheet 1, has been fed out together with the sheet S1 even when there is no contact between the sheet S2 and the pick roller 15. In such a case, as illustrated in FIG. 5E, the succeeding sheet S2 is conveyed the predetermined distance with the sheet S2 pre-feeding operation. Subsequently, as illustrated in FIG. 5F, the fed sheet S1 passes through the separation nip portion 17*a*. In so doing, since the front edge of the succeeding sheet S2 is positioned downstream of the separation nip portion 17*a*, a large snapping sound does not occur when the fed sheet S1 passes through the separation nip portion 17*a*.

An operation of the separation roller 17 will be described next. The force that the separation roller 17 receives due to the friction with the rotating feed roller 16 when there is no sheet S in the separation nip portion 17*a* is set to surpass a rotational load of the torque limiter 18. Accordingly, the separation roller 17 rotates in the direction in which the sheet S is fed. The force that the separation roller 17 receives due to the friction with a single sheet S1 when a sheet S is conveyed to the separation nip portion 17*a* is set to surpass the rotational load of the torque limiter 18. Accordingly, the separation roller 17 rotates in the direction in which the sheet S1 is fed (FIG. 5A). In a case in which a single sheet S1 is conveyed to the separation nip portion 17*a* and in which a sheet S2, due to the friction with the sheet S1, is taken out together with the sheet S1, the rotational load of the torque limiter 18 is set to surpass the force that the separation roller 17 receives due to the friction with the two sheets S1 and S2. Accordingly, the separation roller 17 stops rotating (FIG. 5D).

Furthermore, the force that the separation roller 17 receives due to the friction with the two sheets S1 and S2 in a case in which a single sheet S1 is conveyed with the separation nip portion 17*a* and the sheet S2 is conveyed by the pick roller 15 is set to surpass the rotational load of the torque limiter 18. Accordingly, the separation roller 17 rotates in the direction in which the sheet S1 is fed (FIG. 5E). In a case in which two sheets S1 and S2 are conveyed to the separation nip portion 17*a* and in which a sheet S3, due to the friction with the sheet S2, is taken out together with the sheet S2, the rotational load of the torque limiter 18 is set to surpass the force that the separation roller 17 receives due to the friction with the three sheets S1, S2, and S3. Accordingly, the separation roller 17 stops rotating.

Paying attention to FIGS. 5D and 5E, in a case in which two sheets S1 and S2 are conveyed to the separation nip portion 17*a*, as illustrated in FIG. 5D, when the sheet S2 is taken out together with the sheet 1, the separation roller 17 is stopped and the sheet S2 is not allowed to be conveyed downstream of the separation nip portion 17*a*. Furthermore, as illustrated in FIG. 5E, when the sheet S2 is pre-fed, the separation roller 17 is rotated and the sheet S2 is conveyed downstream of the separation nip portion 17*a*.

Note that in the present embodiment, being fed out together denotes a state in which a preceding sheet is moved due to the friction with the preceding sheet. In other words, being fed out together denotes a state in which the succeeding sheet is moved even when there has been no contact between the pick roller 15 and the succeeding sheet. Meanwhile, pre-feed denotes that the succeeding sheet is moved a predetermined distance in advance with the pick roller 15 during the sheet feeding operation of the preceding sheet. In other words, during the pre-feed, the succeeding sheet and the pick roller 15 are in contact with each other.

Figure 6:
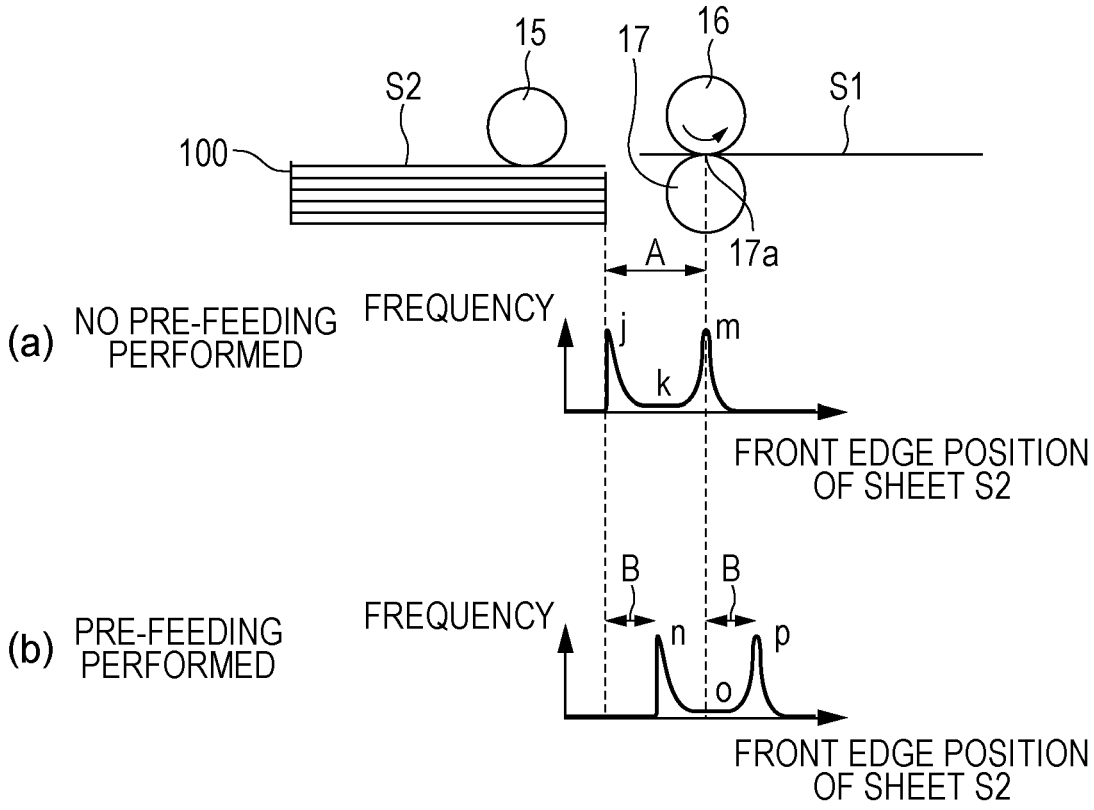
FIG. 6 is a diagram for describing distributions of a front edge position of the sheets according to the first embodiment.

FIG. 6 illustrates distributions of the front edge position of the succeeding sheet S2. In FIG. 6, (a) illustrates a distribution of the front edge position of the sheet S2 in a case in which the sheet pre-feeding operation is not performed. There are two peaks in the distribution of the front edge position of the sheet S2 where the distribution is frequent, namely, at a set position j of the cassette 100 and at a position m of the separation nip portion 17*a*. Furthermore, the frequency at which the front edge of the sheet S2 is positioned in an area k between the position j and the position m is low. The above is caused because a type of sheet S that is not easily fed out together is scarcely moved by the friction with the sheet S1, and a type of sheet S that is easily fed out together is moved due to the friction with the sheet S1, and is separated from the S1 and stopped with the separation nip portion 17*a*.

As illustrated in FIG. 14B, if the front edge of the succeeding sheet S2 is at position m of the separation nip portion 17*a* when the rear edge of the sheet S1 that is being fed passes through the separation nip portion 17*a*, a snapping sound is generated by jerking of the rear edge of the sheet S1 that is being fed due to a step formed by the thickness of the succeeding sheet S2. In a case in which the sheet pre-feeding operation is not performed, since the frequency at which the front edge of the succeeding sheet S2 is at position m of the separation nip portion 17*a* becomes higher, the frequency at which the snapping sound is generated when the rear edge of the sheet S1 that is being fed passes through the separation nip portion 17*a* becomes higher.

In FIG. 6, (b) illustrates a distribution of the front edge position of the sheet S2 in a case in which the sheet pre-feeding operation is performed. The overall distribution of the front edge position of the sheet S2 is shifted to a position proceeding the overall distribution the predetermined distance B downstream in the feeding direction with respect to the case of (a) in FIG. 6 in which the sheet pre-feeding operation is not performed. In the present embodiment, the predetermined distance B that is moved by the sheet pre-feeding operation is set shorter than a distance A from the front edge position j of the sheet S set in the cassette 100 and the position m of the separation nip portion 17*a*. Accordingly, the peaks of the front edge position of the sheet S2 is shifted to a position n upstream of the separation nip portion 17*a* and a position p downstream of the separation nip portion 17*a*. Furthermore, since the frequency at which the front edge of the sheet S2 is at position m (an area o) of the separation nip portion 17*a* is lower, the frequency at which the snapping sound is generated when the rear edge of the sheet S1 that is being fed passes through the separation nip portion 17*a* becomes lower. In other words, the snapping sound can be reduced.

With the above, the present embodiment is capable of providing an image forming apparatus and a feeding apparatus that reduce the snapping sound created when the rear edge of the recording material passes through the separation nip portion.

Second Embodiment

The second embodiment will be described next. In the second embodiment, points that are different from those of the first embodiment will be mainly described and description of the points that are similar to those of the first embodiment will be omitted. A configuration of the second embodiment is the same as that of the first embodiment.

Figure 7:
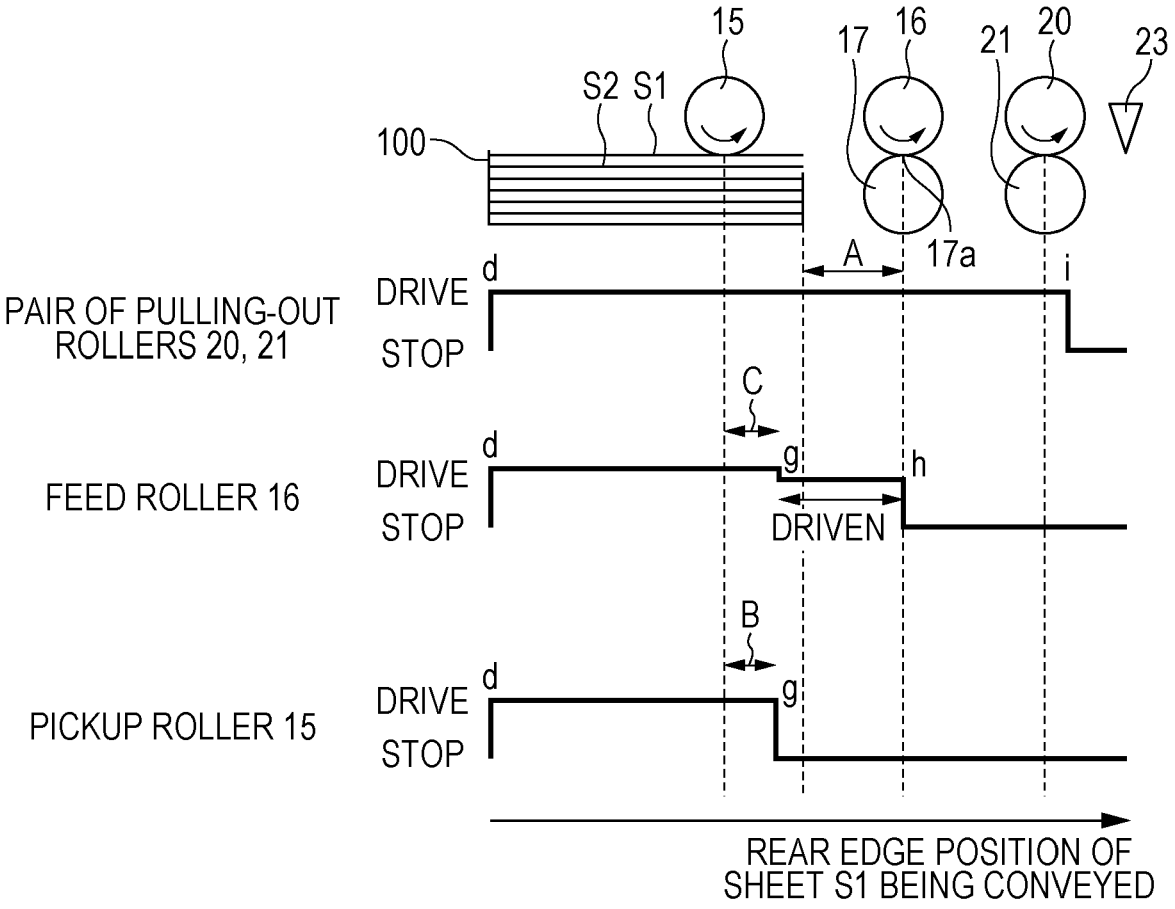
FIG. 7 is a timing chart of a sheet feeding control according to a second embodiment.

Referring to FIG. 7, a feed operation of the present embodiment will be described in detail. FIG. 7 is a timing chart of the control during feeding, and is a diagram schematically illustrating positional relationships between the rear edge position of the sheet S1 and the rollers during feeding.

Upon input of a print signal, the engine control unit 200 rotates the pair of pulling-out rollers 20 and 21 with the motor 201. At substantially the same time, the engine control unit 200 turns the electromagnetic clutch 202 on and rotates the pick roller 15 and the feed roller 16 (a timing at which the rear edge of the sheet S1 is at position d in FIG. 7).

The sheet S1 that has been fed out by the pick roller 15 passes through the separation nip portion 17*a* formed between the feed roller 16 and the separation roller 17, and reaches the pair of pulling-out rollers 20 and 21. In the present embodiment, even when the front edge of the sheet S1 reaches the pair of pulling-out rollers 20 and 21, the engine control unit 200 does not switch the electromagnetic clutch 202 off (does not stop the electromagnetic clutch 202 during operation). Furthermore, the pick roller 15 and the feed roller 16 are continuously rotated. After the rear edge of the sheet S1 passes through the pick roller 15, and when the sheet S2 comes into contact with the pick roller 15, the sheet S2 is pre-fed with the pick roller 15.

Subsequently, the engine control unit 200 turns the electromagnetic clutch 202 off at a timing at which the sheet S2 has been conveyed the predetermined distance B by the pick roller 15. In the above, the sheet S1 also is conveyed the predetermined distance C (=B) by the feed roller 16 and the pair of pulling-out rollers 20 and 21 (a timing at which the rear edge of the sheet S1 is at position g in FIG. 7). Note that due to the configuration of the drive train, drive is transmitted to the feed roller 16 as well during pre-feeding of the sheet S2 and the sheet S1 is conveyed over the distance C; however, there is no issue in not transmitting the drive to the feed roller 16. The control after the above also is the same as that of the first embodiment; accordingly, description thereof is omitted.

In such a case, the timing at which the rear edge of the sheet S1 that is being fed passes through the pick roller 15 slightly varies due to the conveyance speed of the sheet S1 and the length of the sheet S1. Accordingly, since there also is a slight variation in the distance B at which the sheet S2 is moved by the sheet pre-feeding operation, a timing to turn the drive of the pick roller 15 off is set so that the sheet S2 does not become positioned at the separation nip portion 17*a* (g in FIG. 7) even if there is such a variation.

Figure 8:
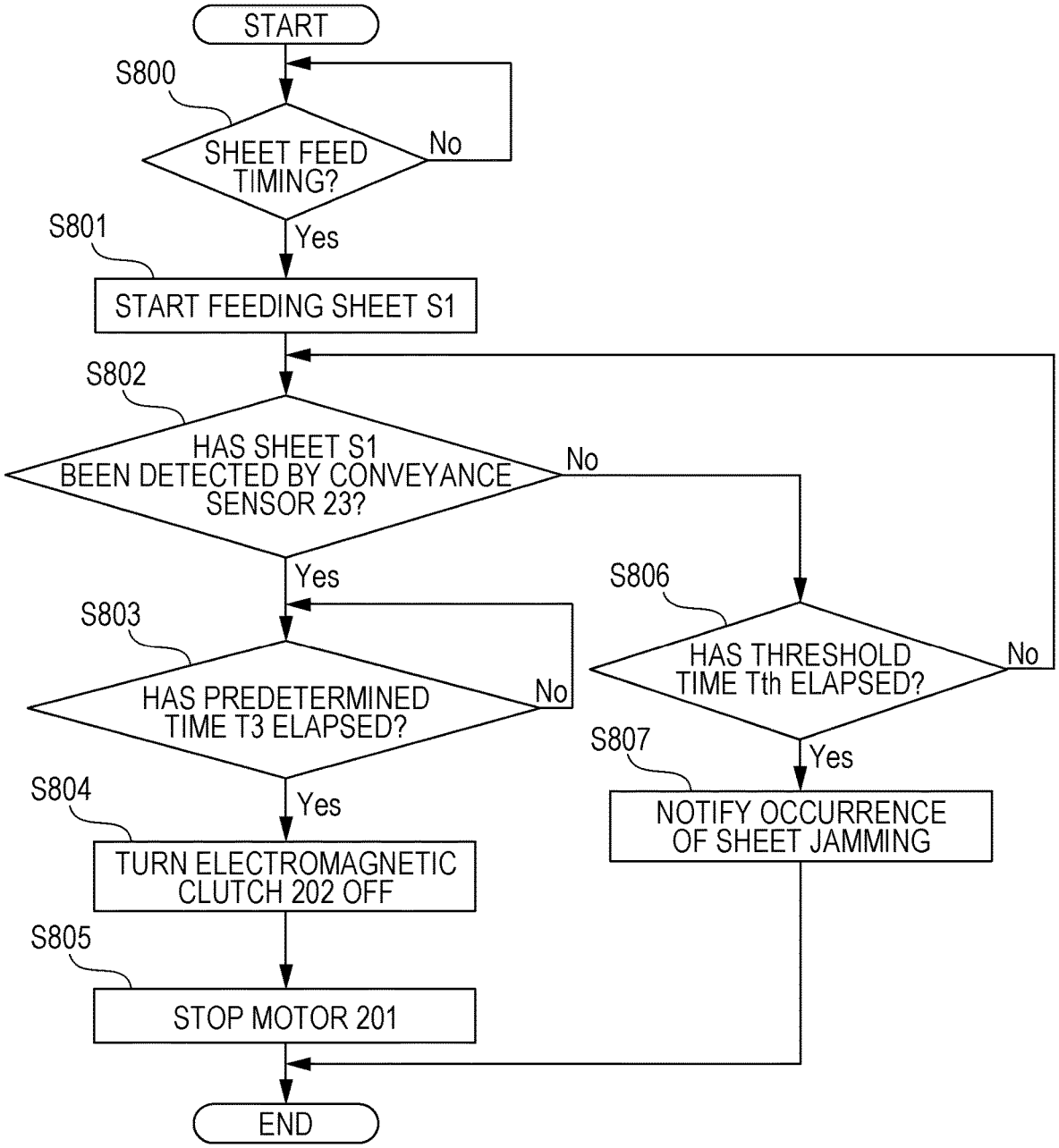
FIG. 8 is a flowchart of the sheet feeding control according to the second embodiment.

A flowchart summarizing the above feed operation is illustrated in FIG. 8. The control based on the flowchart in FIG. 8 is executed by the engine control unit 200 based on a program stored in the ROM and the like.

First, the engine control unit 200 receiving a print command determines whether it is a timing to feed the sheet S from the cassette 100 (S800). When determined that it is a timing to feed the sheet S, the engine control unit 200 starts the sheet feeding operation of the sheet S1 (S801). Specifically, as described above, the motor 201 is driven, and the electromagnetic clutch 202 is turned on. With the above, the pick roller 15, the feed roller 16, and the pair of pulling-out rollers 20 and 21 are rotated.

Subsequently, the engine control unit 200 determines whether the conveyance sensor 23 has detected the sheet S1 (S802). When it is determined that the sheet S1 has been detected by the conveyance sensor 23, the engine control unit 200 determines whether it is a timing at which a predetermined time T3 has passed since the sheet S1 has been detected by the conveyance sensor 23 (S803). The predetermined time T3 is a time period that is longer than the predetermined time T1 in the first embodiment, and the timing at which the predetermined time T3 has passed is a timing at which the rear edge of the sheet S1 has passed through the pick roller 15 and, further, when the sheet S2 is conveyed over the predetermined distance B. When determined that it is a timing at which the predetermined time T3 has passed, the engine control unit 200 turns the electromagnetic clutch 202 off to end the sheet S2 pre-feeding operation (S804). After the conveyance of the sheet S1 is completed, the engine control unit 200 stops the motor 201 (S805).

On the other hand, in S802, when it is determined that the conveyance sensor 23 has not detected the sheet S1, the engine control unit 200 determines whether it is a timing at which a threshold time Tth has passed from after the sheet S1 feeding operation has been started (S806). Note that the threshold time Tth is a time period that is at least longer than the predetermined time T3. When determined that it is a timing at which the threshold time Tth has passed, the engine control unit 200 displays, on an operation panel (not shown) provided in the printer 90, a message that a sheet jamming has occurred (S807). With the above, the control in the present flowchart ends.

With the above, the present embodiment is capable of providing an image forming apparatus and a feeding apparatus that reduce the snapping sound created when the rear edge of the recording material passes through the separation nip portion.

Furthermore, the present embodiment has a benefit in reducing the effect of a back tension caused by turning the electromagnetic clutch 202 off, by rotating the pick roller 15 continuously. The above leads to a stabilization of the conveyance speed of the sheet S1 conveyed by the pair of pulling-out rollers 20 and 21. Since the electromagnetic clutch 202 is not turned off while the pick roller 15 is in contact with the sheet S1, the pick roller 15 is not transferred to a driven state. Accordingly, occurrence of back tension due to the pick roller 15 and change in the conveyance speed of the sheet S1 can be prevented from happening.

Third Embodiment

The third embodiment will be described next. In the third embodiment, points that are different from those of the first embodiment will be mainly described and description of the points that are similar to those of the first embodiment will be omitted. A configuration of the third embodiment is the same as that of the first embodiment.

Figure 9:
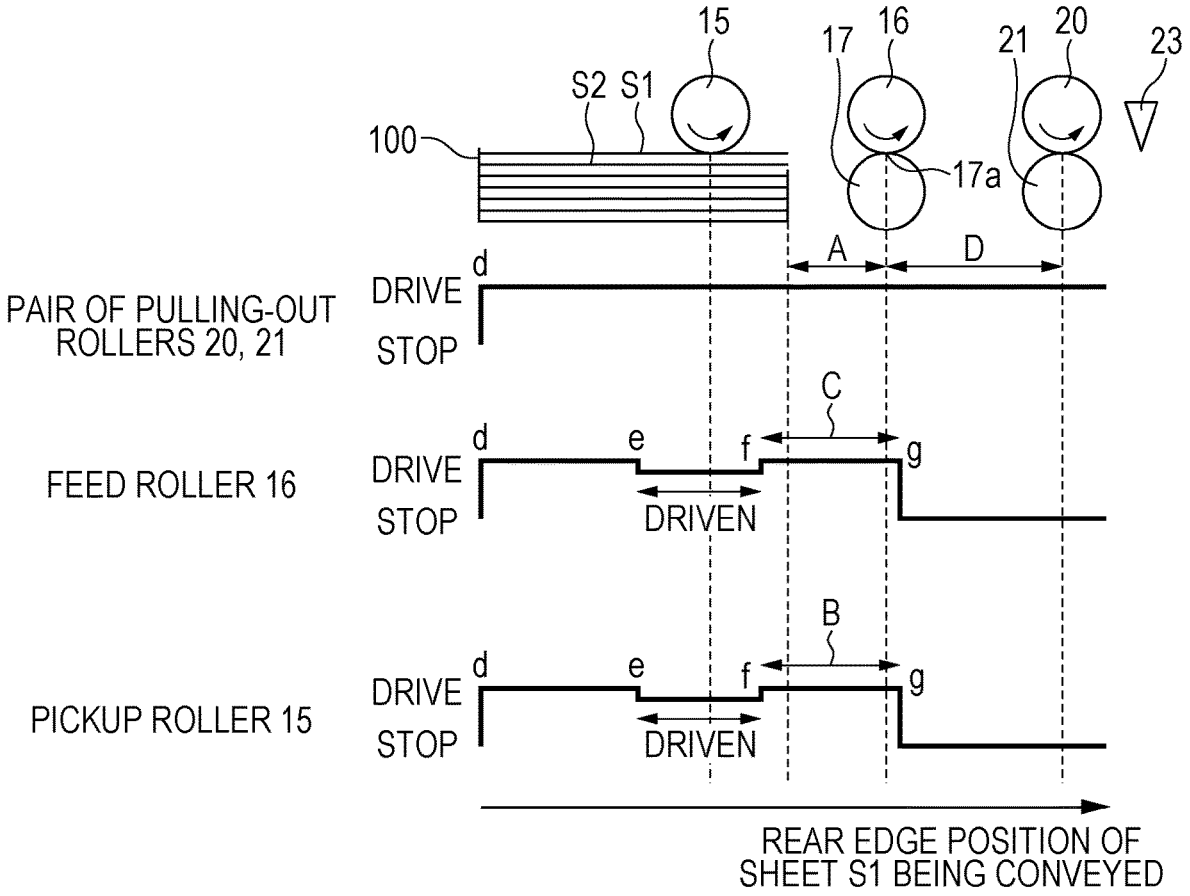
FIG. 9 is a timing chart of a sheet feeding control according to a third embodiment.

Referring to FIG. 9, a feed operation of the present embodiment will be described in detail. FIG. 9 is a timing chart of the control during feeding, and is a diagram schematically illustrating positional relationships between the rear edge position of the sheet S1 and the rollers during feeding.

The present embodiment is different from the first embodiment in the distance in which the sheet S2 is pre-fed. In the present embodiment, the predetermined distance B in which the sheet S2 is pre-fed is set longer than the distance A. Note that the distance A is, as described in the first embodiment, the distance from the sheet setting position of the cassette 100 to the separation nip portion 17*a*.

Figure 10:
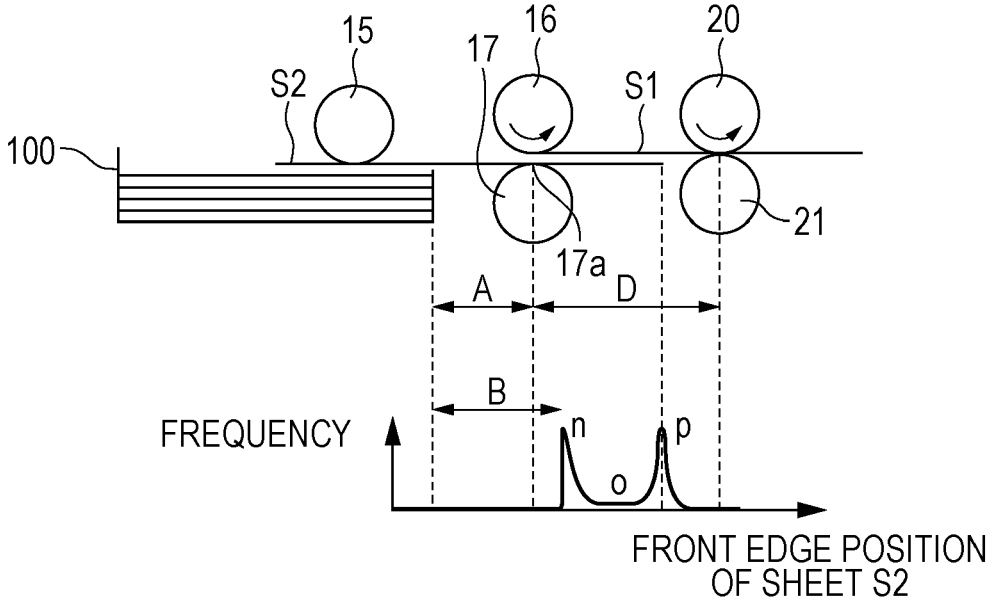
FIG. 10 is a diagram for describing distributions of a front edge position of the sheets according to the third embodiment.

FIG. 10 illustrates distributions of the front edge position of the succeeding sheet S2. In the present embodiment, since the distance in which the sheet S2 is conveyed in the sheet pre-feeding operation is longer compared with that of the first embodiment, even in a state in which the sheet S2 is not fed out together with another sheet by friction, the front edge of the sheet S2 is positioned downstream of the separation nip portion 17*a*. Accordingly, the sheet S1 that has been fed does not generate a large snapping sound when passing the separation nip portion 17*a*.

Furthermore, when the front edge of the succeeding sheet S2 reaches the pair of pulling-out rollers 20 and 21 in the sheet pre-feeding operation, the succeeding sheet S2 is disadvantageously conveyed together with the fed sheet S1 in an overlapped state. In order to prevent the above, the predetermined distance B in which the sheet S2 is conveyed in the sheet pre-feeding operation is set shorter than a distance D from the separation nip portion 17*a* to the pair of pulling-out rollers 20 and 21. In other words, a relationship distance $A$<distance $B$<distance $D$ is to be satisfied.

Furthermore, a flowchart of the present embodiment is basically the same as that in FIG. 4, except for the timing in which the sheet S2 pre-feeding operation is ended, in other words, only the length of the predetermined time T2 in S406 differs. In the present embodiment, since the distance in which the sheet S2 is conveyed in the sheet pre-feeding operation is to be longer than that in the first embodiment, the predetermined time T2 also is to be set longer than that of the first embodiment.

With the above, the present embodiment is capable of providing an image forming apparatus and a feeding apparatus that reduce the snapping sound created when the rear edge of the recording material passes through the separation nip portion.

Furthermore, in the present embodiment, since the front edge of the sheet S2 is positioned downstream of the separation nip portion 17*a*, the snapping sound that is generated when the rear edge of the sheet S1 passes through the separation nip portion 17*a* can be reduced in a more reliable manner than the first embodiment.

In the printer 90 depicted in FIG. 1, a curvature of a conveyance path downstream of the separation nip portion 17*a* is larger than a curvature of the conveyance path upstream of the separation nip portion 17*a*. Accordingly, when the rear edge of the sheet S1 passes through the separation nip portion 17*a*, there are cases in which a phenomenon in which the rear edge jerks occurs due to the stiffness of the sheet S1. In such cases, the rear edge of the sheet S1 impinging against the feed roller 16 and the separation roller 17, and further with the conveyance guide and the like therearound generates an abnormal noise.

In the present embodiment, since the front edge of the sheet S2 is positioned downstream of the separation nip portion 17*a*, the sheet S2 can support the rear edge of the sheet S1 when the rear edge of the sheet S1 passes through the separation nip portion 17*a*. In other words, a noise reduction effect, the noise being generated by jerking of the rear edge of the sheet S1, can be obtained.

Fourth Embodiment

The fourth embodiment will be described next. In the fourth embodiment, points that are different from those of the first embodiment will be mainly described and description of the points that are similar to those of the first embodiment will be omitted. A configuration of the fourth embodiment is the same as that of the first embodiment.

Figure 11:
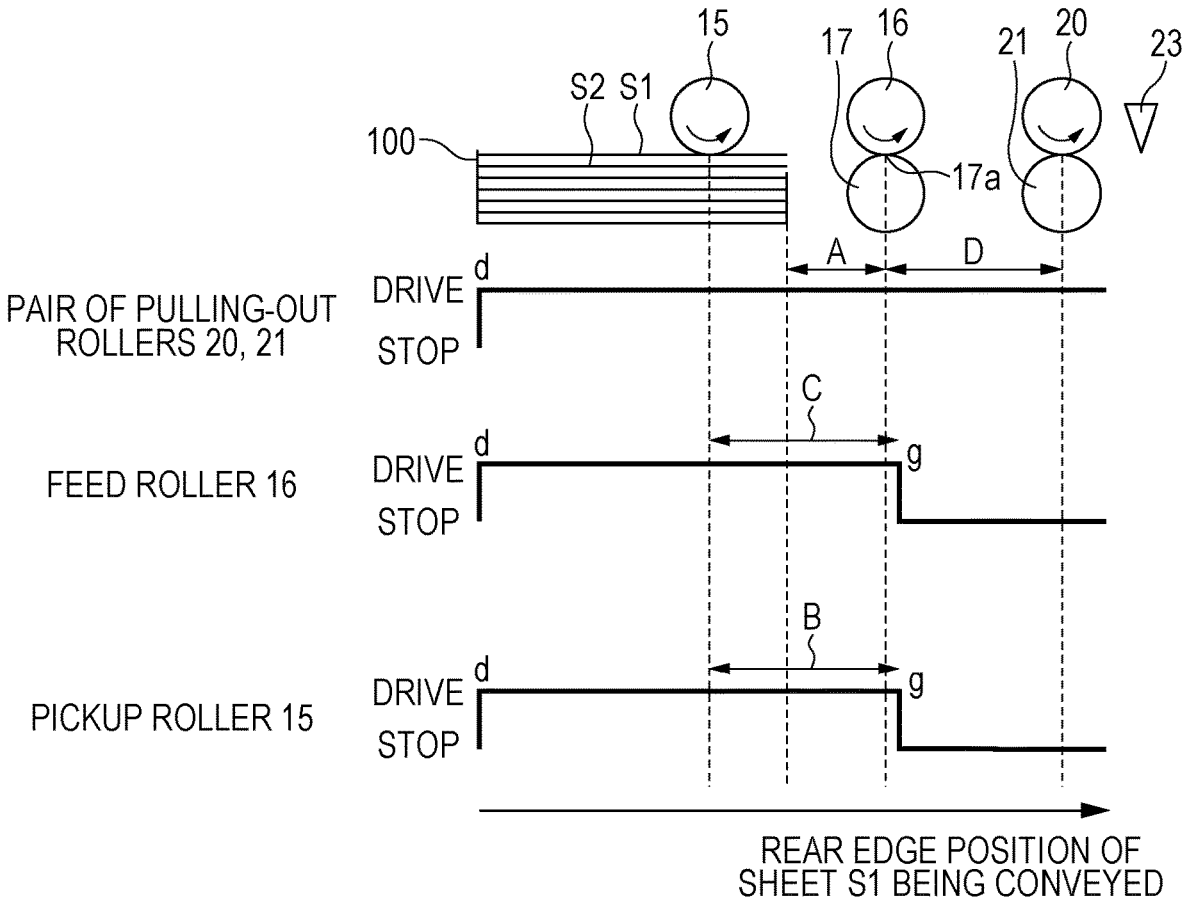
FIG. 11 is a timing chart of a sheet feeding control according to a fourth embodiment.

Referring to FIG. 11, a feed operation of the present embodiment will be described in detail. FIG. 11 is a timing chart of the control during feeding, and is a diagram schematically illustrating positional relationships between the rear edge position of the sheet S1 and the rollers during feeding.

In the present embodiment, first, as described in the second embodiment, the electromagnetic clutch 202 is not turned off before the rear edge of the sheet S1 passes the pick roller 15, and the pick roller 15 and the feed roller 16 are continuously rotated. Furthermore, the sheet S2 pre-feeding operation is executed after the rear edge of the sheet S1 has passed the pick roller 15.

The present embodiment is different from the second embodiment in the distance in which the sheet S2 is pre-fed. In the present embodiment, the predetermined distance B in which the sheet S2 is pre-fed is set longer than the distance A. Note that the distance A is, as described in the first embodiment, the distance from the sheet setting position of the cassette 100 to the separation nip portion 17*a*.

In other words, the present embodiment corresponds to a combination of the second embodiment and the third embodiment. In the present embodiment as well, since the distance in which the sheet S2 is conveyed in the sheet pre-feeding operation is longer compared with that of the first embodiment, even in a state in which the sheet S2 is not fed out together with another sheet by friction, the front edge of the sheet S2 is positioned downstream of the separation nip portion 17*a*. Accordingly, the sheet S1 that has been fed does not generate a large snapping sound when passing the separation nip portion 17*a*.

Furthermore, similar to the third embodiment, when the front edge of the succeeding sheet S2 reaches the pair of pulling-out rollers 20 and 21 in the sheet per-feeding operation, the succeeding sheet S2 is disadvantageously conveyed together with the fed sheet S1 in an overlapped state. In order to prevent the above, the predetermined distance B in which the sheet S2 is conveyed in the sheet pre-feeding operation is set shorter than the distance D from the separation nip portion 17*a* to the pair of pulling-out rollers 20 and 21. In other words, a relationship distance A<distance B<distance D is to be satisfied.

Furthermore, a flowchart of the present embodiment is basically the same as that in FIG. 8, except for the timing in which the sheet S2 pre-feeding operation is ended, in other words, only the length of the predetermined time T3 in S803 differs. In the present embodiment, since the distance in which the sheet S2 is conveyed in the sheet pre-feeding operation is to be longer than that in the second embodiment, the predetermined time T3 also is to be set longer than that of the second embodiment.

With the above, the present embodiment is capable of providing an image forming apparatus and a feeding apparatus that reduce the snapping sound created when the rear edge of the recording material passes through the separation nip portion.

Furthermore, in the present embodiment, since the front edge of the sheet S2 is positioned downstream of the separation nip portion 17*a*, the snapping sound that is generated when the rear edge of the sheet S1 passes through the separation nip portion 17*a* can be reduced in a more reliable manner than the first embodiment.

Moreover, the present embodiment has a benefit in reducing the effect of a back tension caused by turning the electromagnetic clutch 202 off, by rotating the pick roller 15 and the feed roller 16 continuously. The above leads to a stabilization of the conveyance speed of the sheet S1 conveyed by the pair of pulling-out rollers 20 and 21. Since the electromagnetic clutch 202 is not turned off while the pick roller 15 and the feed roller 16 are in contact with the sheet S1, the pick roller 15 and the feed roller 16 are not transferred to a driven state. Accordingly, occurrence of back tension due to the pick roller 15 and the feed roller 16, and change in the conveyance speed of the sheet S1 can be prevented from happening.

Similar to the third embodiment, in the present embodiment as well, since the front edge of the sheet S2 is positioned downstream of the separation nip portion 17*a*, the sheet S2 can support the rear edge of the sheet S1 when the rear edge of the sheet S1 passes through the separation nip portion 17*a*. In other words, a noise reduction effect, the noise being generated by jerking of the rear edge of the sheet S1, can be obtained.

In the third and fourth embodiments, the front edge of the sheet S2 is positioned at least 2 mm or more downstream of the separation nip portion 17*a* in the feeding direction. Note that in a case in which the separation nip portion 17*a* has a predetermined width, the above denotes that the front edge of the sheet S2 is positioned 2 mm or more downstream of the end of the separation nip portion 17*a* on the downstream side in the feeding direction.

Furthermore, in the first and second embodiments, there are cases in which the sheet S is nipped in the separation nip portion 17*a* in the sheet pre-feeding operation, and in the third and fourth embodiments, the sheet S is nipped in the separation nip portion 17*a*. When left unattended in the above state for a long time, a trace may be created on the sheet S by the nip pressure, which may disadvantageously have an effect on the image formed on the sheet S. Accordingly, when feeding the last sheet S of the print job, the sheet pre-feeding operation of the succeeding sheet may not be executed. In other words, when the last sheet S is fed, a control is performed such that the electromagnetic clutch 202 is turned off before the rear edge of the last sheet S passes the pick roller 15.

Furthermore, in the first to fourth embodiments described above, the sheet pre-feeding operation has been performed regardless of the type of sheet S that is fed. However, whether to perform the sheet pre-feeding operation or not may be switched based on the thickness or the grammage of the sheet S that is fed. The reason for the above will be described in detail.

In a case in which the sheet S that is fed is a thin sheet, the sheet S may become warped due to the sheet pre-feeding operation. The above is because the rigidity of the thin sheet S itself is low and the thin sheet S yields to the resistance thereon when passing through the separation nip portion 17*a*. Furthermore, since the step formed by the thin sheet S when the rear edge of the sheet S1 that is being fed passes through the separation nip portion 17*a* is small, the snapping sound is small as well. Accordingly, the engine control unit 200 may perform a control in which the sheet pre-feeding operation is not executed when the type of sheet S that is fed is determined to be the thin sheet S, and may perform a control in which the sheet pre-feeding operation is executed when the type of sheet S is determined to be a thick sheet S. Note that the threshold value of the thickness of the sheet S determining whether to perform the sheet pre-feeding operation is different in each device; accordingly, the optimum value may be derived through an experiment.

Figure 12:
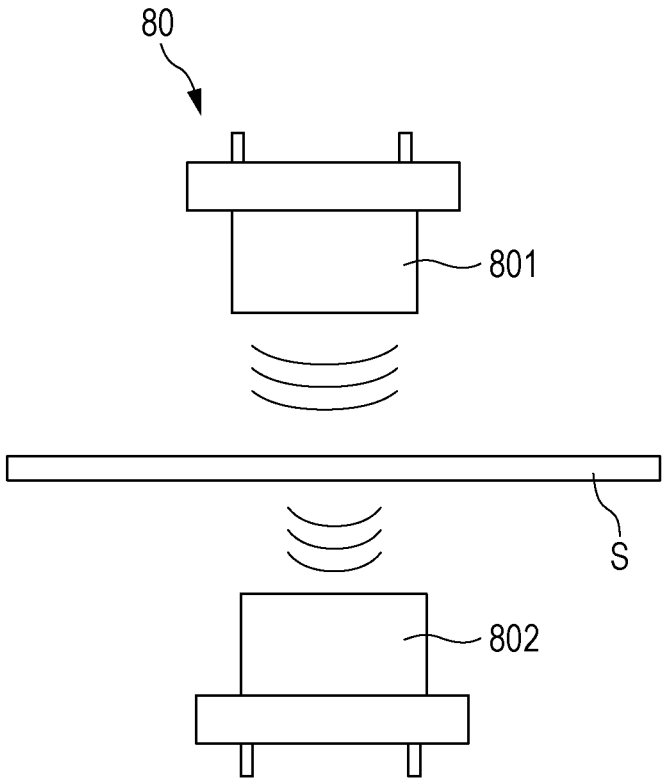
FIG. 12 is a diagram illustrating an ultrasonic sensor according to another embodiment.

The engine control unit 200 may perform the above determination based on information related to the thickness of the sheet S, which is input by a user through an operation panel (not shown) provided in the printer 90. Furthermore, an ultrasonic sensor 80 illustrated in FIG. 12 may be disposed in the conveyance path of the printer 90, and the grammage of the sheet S may be detected by receiving an ultrasonic wave that has been attenuated through the sheet S. The ultrasonic sensor 80 includes a transmitting unit 801 that transmits an ultrasonic wave, and a receiving unit 802 that receives the ultrasonic wave. In such a case, the engine control unit 200 may perform the above determination based on the information of the thickness of the sheet S that is indirectly obtained from the grammage of the sheet S.

Furthermore, in the first to fourth embodiments described above, the separation roller 17 is used to separate a single sheet S from a plurality of sheets S; however, the separation of the sheets is not limited to the above method. A retard roller that rotates in a direction opposite the feed direction of the sheet S and that separates a plurality of sheets S into single sheets S may be used.

Furthermore, in the first to fourth embodiments described above, a configuration in which the engine control unit 200 controls the pick roller 15 and the feed roller 16 through a single electromagnetic clutch 202 has been described. However, the configuration is not limited to the above. The engine control unit 200 may be capable of controlling each of the pick roller 15 and the feed roller 16 independently. For example, an electromagnetic clutch may be provided between the motor 201 and the pick roller 15 and, further, another electromagnetic clutch may be provided between the motor 201 and the feed roller 16.

In a case in which such a configuration is adopted, the sheet S1 feeding operation is started by, for example, turning the electromagnetic clutch between the motor 201 and the pick roller 15 on and the electromagnetic clutch between the motor 201 and the feed roller 16 on. Subsequently, the electromagnetic clutch between the motor 201 and the pick roller 15 alone is turned off after the sheet S2 pre-feeding operation with the pick roller 15 has been completed. It is further possible to continue the sheet S1 feeding operation with the feed roller 16 while keeping the electromagnetic clutch between the motor 201 and the feed roller 16 on. In other words, in the above case, the pair of pulling-out rollers 20 and 21 does not need to pull out the sheet S1 from the separation nip portion 17*a*, and the feed roller 16 may feed the sheet S1 downstream.

Figure 13:
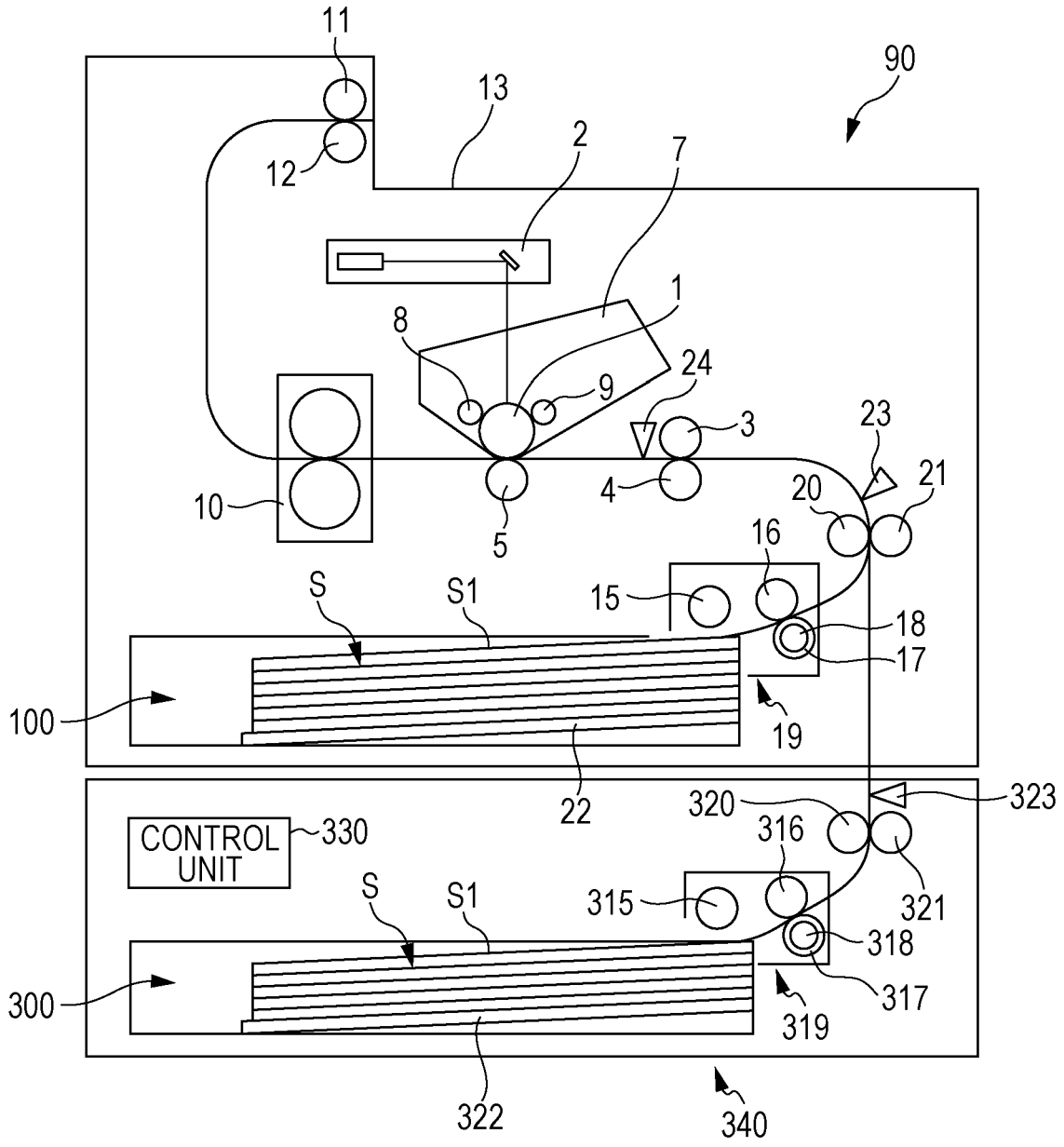
FIG. 13 is a cross-sectional view of an option paper feeding device according to another embodiment.

Furthermore, in the first to fourth embodiments described above, the description has been given using a feeding apparatus that is fixed to the printer 90. However, not limited to the above, an option paper feeding device 340 that is detachable from the printer 90 described in FIG. 13 may be used.

The configuration of the option paper feeding device 340 is substantially the same as that of the feeding apparatus illustrated in FIG. 1. The option paper feeding device 340 includes a cassette 300 and a roller unit 319. A sheet stacking plate 322 that is a stack portion on which a plurality of sheets S are stacked is provided in the cassette 300. In a stand-by state, the sheets S are lifted up to a feed-out position with the sheet stacking plate 322, and the sheet S1 at the uppermost position is in contact with a pickup roller 315. Upon input of a print signal, a pick roller 315 feeds the sheet S1 from the sheets S stacked on the sheet stacking plate 322. A feed roller 316 feeds the sheet S1, which has been fed by the pick roller 315, further downstream. A separation roller 317 is fixed to a chassis or the like of the option paper feeding device 340 with a torque limiter 318 in between.

The sheet S1 that has been fed with the feed roller 316 is conveyed to the printer 90 with a pair of pulling-out rollers 320 and 321. A conveyance sensor 323 detects the sheet S1 that is being con eyed. Furthermore, a control unit 330 is provided in the option paper feeding device 340, and the control of the printer 90 is similar to the control illustrated in the block diagram in FIG. 2. Furthermore, the control unit may not be mounted in the option paper feeding device 340, and the control of each roller provided in the option paper feeding device 340 may be performed by the engine control unit 200 on the printer side.

An issue addressed by fifth and sixth embodiments will be described in detail.

In conventional image forming apparatuses, such as copiers, printers, and facsimile apparatuses, sheets P accommodated in a sheet feeding cassette 240 that is detachable from the apparatus body are fed by a pickup roller 210. The fed sheets P are separated into single sheets in a separation nip portion formed between a feed roller 220 and a separation roller 230, and are conveyed to the image forming unit including a secondary transfer roller 120 (see FIG. 27). After the sheet P that has been fed by the pickup roller 210 and the feed roller 220 is nipped between the pair of registration rollers 203 on the downstream side in a conveyance direction, drive of a roller unit is stopped, and the sheet P is conveyed towards the secondary transfer roller 120 with the pair of registration rollers 203. Note that the roller unit refers to the two rollers, namely, the pickup roller 210 and the feed roller 220. The roller unit rotates while being driven by the sheet P that is conveyed by the pair of registration rollers 203. However, at the timing at which the drive of the roller unit is switched from driving to being driven, a load (hereinafter, referred to as a back tension) acts on the sheet P and, disadvantageously, the conveyance of the sheet P becomes instantaneously slow (see FIG. 27A). Furthermore, when a rear edge of the sheet P passes the driven roller unit, since there will be no back tension, disadvantageously, the conveyance of the sheet P becomes instantaneously fast (see FIG. 27B). When an image is formed on the sheet with the secondary transfer roller 120 at such a timing, there are cases in which the above has an effect on the image (occurrence of an image defect). The effect of the back tension increases as the apparatus body becomes smaller.

The fifth and sixth embodiments provide an image forming apparatus that reduces the image defect created when the rear edge of the recording material passes through the separation nip portion.

Fifth Embodiment

Overall Configuration and Operation of Image Forming Apparatus

Figure 15A:
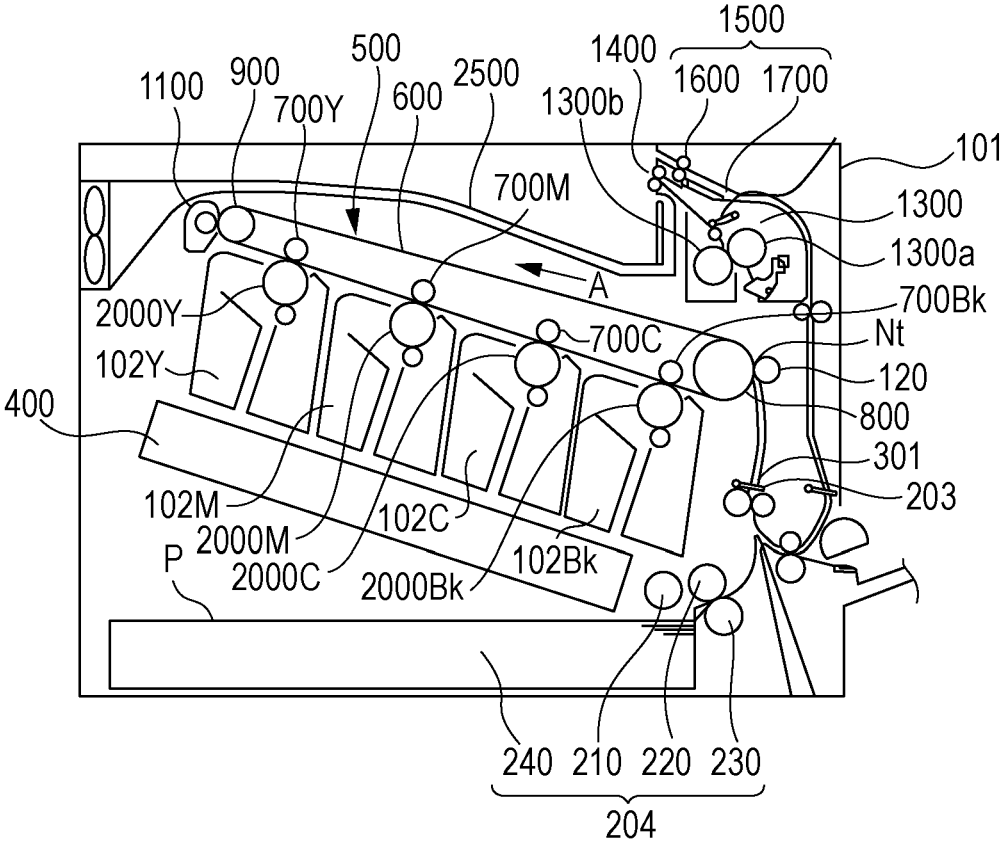
FIGS. 15A and 15B are a cross-sectional view illustrating a configuration of an image forming apparatus according to fifth and sixth embodiments and a cross-sectional view illustrating a configuration of a feeding unit.

A color laser beam printer (hereinafter, merely referred to as a printer) 101 serving as an image forming apparatus of the fifth embodiment will be described with reference to FIG. 15A. FIG. 15A is a cross-sectional view illustrating an overall configuration of the printer 101. The printer 101 includes the sheet feeding cassette 240 serving as a storage portion at the lower side of the main body of the main body of the printer 101. The pair of registration rollers 203 and a top sensor 301 (a detection unit) are provided above the sheet feeding cassette 240. The pair of registration rollers 203 conveys, at a timing that matches the image with the sheet P serving as a recording material fed from the sheet feeding cassette 240. The top sensor 301 detects the position of the sheet P and a paper jam (also referred to as sheet jamming) of the sheet P.

A scanner unit 400 is provided above the sheet feeding cassette 240. Four process cartridges 102Y, 102M, 102C, and 102Bk are provided above the scanner unit 400. Note that while Y denotes yellow, M denotes magenta, C denotes cyan, Bk denotes black, hereinafter, except for when a specific color is being described, the attached letters Y, M, C, and Bk are omitted. An intermediate transfer unit 500 is disposed above the process cartridges 102 to oppose the process cartridges 102. The intermediate transfer unit 500 includes, inside an intermediate transfer belt 600, primary transfer rollers 700, a drive roller 800, and a tension roller 900 and, further, is provided with a cleaning device 1100. The secondary transfer roller 120 (the image forming unit) is provided on the right side of the intermediate transfer unit 500 to oppose the drive roller 800. A fixing unit 1300 is disposed above the intermediate transfer unit 500 and the secondary transfer roller 120. A pair of discharge rollers 1400 and a reversing unit 1500 are disposed at the upper left portion of the fixing unit 1300. The reversing unit 1500 includes a pair of reversing rollers 1600 and a flapper 1700.

An image forming operation of the printer 101 will be described next. The printer 101 illustrated in FIG. 15A sequentially transfers toner images of various colors formed with the scanner unit 400, photosensitive drums 2000, serving as image carrying members, and the like onto the intermediate transfer belt 600 rotating anticlockwise (in direction A), and superimposes the toner images of various colors. With the above, a full color toner image is formed on the intermediate transfer belt 600. The sheets P accommodated in the sheet feeding cassette 240 are picked up by the pickup roller 210 (the feeding member), are separated from each other with the feed roller 220 (the conveying member) and the separation roller 230 (the separation member), and are conveyed to the pair of registration rollers 203. Note that the sheet feeding cassette 240, the pickup roller 210, the feed roller 220, and the separation roller 230 constitute a sheet feeding unit 204. The front edge of the sheet P conveyed by the pair of registration rollers 203 is detected by the top sensor 301 provided downstream of the pair of registration rollers 203 in the conveyance direction. The conveyance speed of the pair of registration rollers 203 is increased or decreased based on the detection result of the top sensor 301. With the above, the sheet P is conveyed to a transfer position Nt at a timing at which the sheet P matches the toner image on the intermediate transfer belt 600. As described above, the conveyance speed of the sheet P changes since the conveyance speed is changed based on the detection result of the top sensor 301 so that the sheet P is conveyed at a timing at which the sheet P matches the toner image on the intermediate transfer belt 600. In the transfer position Nt, the sheet P is pinched between the intermediate transfer belt 600 and the secondary transfer roller 120 and is conveyed at a uniform speed; accordingly, toner image is transferred to the sheet P with the secondary transfer roller 120. The transfer position Nt also is a position of the nip portion formed between the secondary transfer roller 120 and the drive roller 800. The sheet P onto which the toner image has been transferred at the transfer position Nt is conveyed to the fixing unit 1300. In the fixing unit 1300, the unfixed toner image that has been transferred to the sheet P is fixed by a pressure roller 1300*a* and a heat roller 1300*b*. The sheet P to which the toner image has been fixed is discharged to a discharge tray 2500 on an upper portion of the printer 101 with the pair of discharge rollers 1400.

Feeding Unit

Figure 15B:
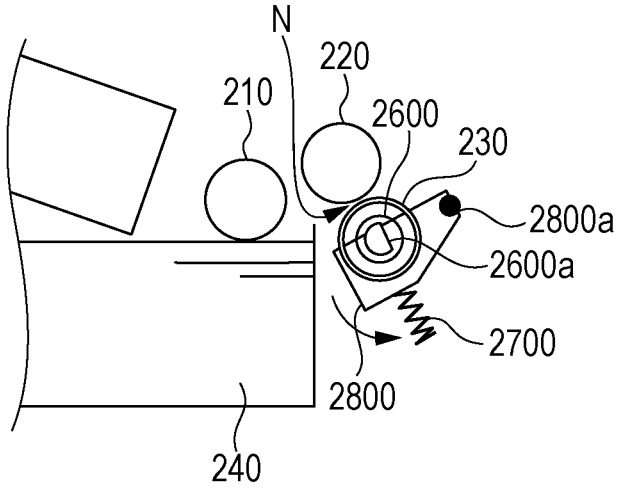

FIG. 15B is a diagram illustrating a configuration of the vicinity of the sheet feeding unit 204. FIG. 15B is, in particular, a cross-sectional view illustrating a configuration of the pickup roller 210 that feeds the sheets P, and the feed roller 220 and the separation roller 230 that separate the sheets P fed by the pickup roller 210 into single sheets. The pickup roller 210 is supported by the main body of the printer 101, and feeds the sheet P accommodated in the sheet feeding cassette 240. The sheet feeding cassette 240 can be drawn out from the main body of the printer 101 or can be mounted in the main body of the printer 101. In a state in which the sheet feeding cassette 240 is accommodated in the printer 101 and in which the pickup roller 210 is driven by a sheet feed drive unit (not shown), the pickup roller 210 is abutted against the sheet P at all times. The pickup roller 210 picks up the sheet P and conveys the sheet P towards a separation nip portion N formed between the feed roller 220 and the separation roller 230. The feed roller 220 is provided downstream of the pickup roller 210 in the conveyance direction, and the sheet P that has been conveyed by the feed roller 220 is conveyed towards the pair of registration rollers 203.

As illustrated in FIG. 15B, the separation roller 230 includes, inside the roller thereof, a torque limiter 2600. A D-shaped shaft portion 2600*a* is mounted in the torque limiter 2600 in a non-rotational state with respect to a holder 2800. The holder 2800 is supported by the sheet feeding cassette 240, and is configured to be pivotal about a rotation center 2800*a*. The separation roller 230 is urged against the feed roller 220 with a compression spring 2700 with the holder 2800 in between. In a state in which the sheet P is nipped between the feed roller 220 and the separation roller 230, the holder 2800 pivots about the rotation center 2800*a* in the arrow direction (anticlockwise) in FIG. 15B due to the thickness of the sheet P.

Operation of Separation Roller

An operation of the separation roller 230 will be described. Note that the sheet P inside the sheet feeding cassette 240 and on the top is referred to as a sheet P1, and the succeeding sheets P that are fed after the sheet P1 are referred to as a sheet P2 and the like. The force that the separation roller 230 receives due to the friction with the rotating feed roller 220 when there is no sheet P in the separation nip portion N is set to surpass a rotational load of the torque limiter 2600. Accordingly, the separation roller 230 rotates in the direction in which the sheet P is fed. The force that the separation roller 230 receives due to the friction with a single sheet P when a sheet P is conveyed to the separation nip portion N is set to surpass the rotational load of the torque limiter 2600. Accordingly, the separation roller 230 rotates in the direction in which the sheet P is fed. In a case in which a single sheet P1 is conveyed to the separation nip portion N and in which the sheet P2, due to the friction with the sheet P1, is taken out together with the sheet P1, the rotational load of the torque limiter 2600 is set to surpass the force that the separation roller 230 receives due to the friction with the two sheets P1 and P2. Accordingly, the separation roller 230 stops rotating. Note that a state in which the sheet P2 is taken out together with the sheet P1 due to the friction with the sheet P1 refers to a state in which the sheet P2 is moving even when the sheet P2 is not in contact with the pickup roller 210.

On the other hand, in a case in which a single sheet P1 is conveyed to the separation nip portion N and, further, in a case in which the sheet P2 comes into contact with the pickup roller 210 and is conveyed, the force that the separation roller 230 receives due to the friction with the two sheets P1 and P2 is set to surpass the rotational load of the torque limiter 2600. Accordingly, the separation roller 230 rotates in the direction in which the sheet P1 is fed. In a case in which two sheets P1 and P2 are conveyed to the separation nip portion N and in which a sheet P3, due to the friction with the sheet P2, is taken out together with the sheet P2, the rotational load of the torque limiter 2600 is set to surpass the force that the separation roller 230 receives due to the friction with the three sheets P1, P2, and P3. Accordingly, the separation roller 230 stops rotating. Note that a state in which the sheet P3 is taken out together with the sheet P2 due to the friction with the sheet P2 refers to a state in which the sheet P3 is moving even when the sheet P3 is not in contact with the pickup roller 210.

Note that FIG. 17A-1 is a diagram illustrating how the sheet P is fed and how each roller operates, and is a diagram illustrating the portion related to the feeding and conveyance of the sheet. In the diagram, solid line arrows depict the directions in which the rollers driven by the motor are rotated, and broken line arrows depict the directions in which the driven rollers rotate. In a case in which the feed roller 220 is rotating and in which a single sheet P is conveyed, as illustrated in FIG. 17A-1, the separation roller 230 being driven by the feed roller 220 or the conveyed sheet P rotates clockwise. On the other hand, when a plurality of sheets P are conveyed by the pickup roller 210 in an overlapped state, the separation roller 230 does not rotate. Accordingly, the sheet is separated sheet by sheet. The pickup roller 210, the feed roller 220, and the pair of registration rollers 203 are driven by a motor M1 (see FIG. 16) serving as the driving source thereof. Furthermore, the drive from the motor M1 to the pickup roller 210 and the feed roller 220 is connected (turned on) and disconnected (turned off) by an electromagnetic clutch C (see FIG. 16).

Furthermore, since a one way gear is built-in inside each of the pickup roller 210 and the feed roller 220, even when transmission of the driving force to the pickup roller 210 and the feed roller 220 is stopped, the pickup roller 210 and the feed roller 220 can be rotated by following the conveyed sheet P. In other words, as long as the sheet P is conveyed by the pair of registration rollers 203, the pickup roller 210 and the feed roller 220, to which transmission of the driving force has been stopped, are rotated by following the conveyed sheet P. The intermediate transfer belt 600 of the intermediate transfer unit 500 is rotated in the arrow direction (anticlockwise) in FIG. 17A-1 with the drive roller 800 driven by a motor M2 (see FIG. 16) that is a driving source different from the motor M1. Note that the secondary transfer roller 120 is rotated clockwise by following the movement of the intermediate transfer belt 600.

Generation of Back Tension

Figure 27A:
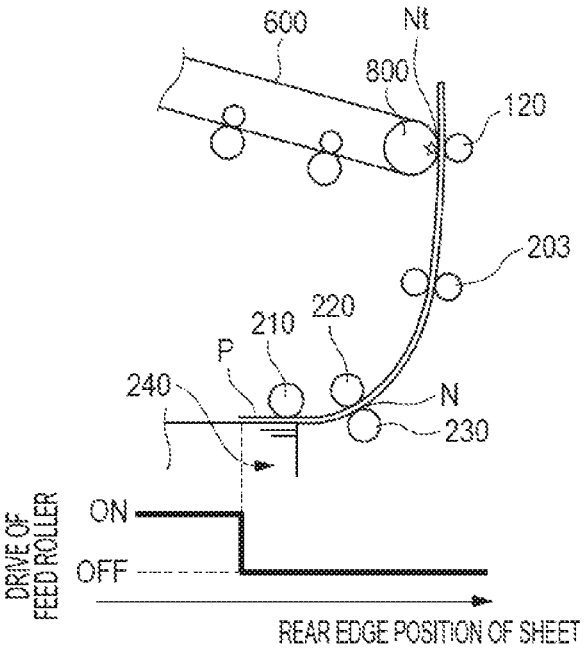
FIG. 27A Prior Art
FIGS. 27A and 27B are cross-sectional views illustrating a sheet conveying operation of the conventional art.
Figure 27B:
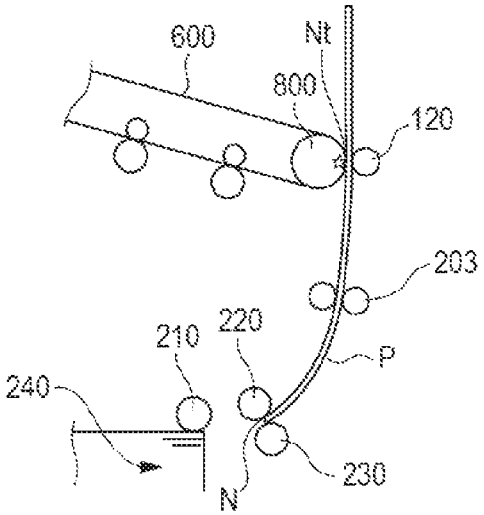
FIG. 27B Prior Art

In a conventional printer 101, the pickup roller 210 and the feed roller 220 (hereinafter, the two rollers will be referred to as a roller unit as well) are controlled in the following manner. In other words, after the sheet P that has been fed by the roller unit is nipped between the pair of registration rollers 203, drive of the roller unit is stopped, and the sheet P is conveyed towards the secondary transfer roller 120 with the pair of registration rollers 203. FIGS. 27A and 27B are cross-sectional views illustrating a conventional conveying operation of the sheet P, and are diagrams illustrating the portion from the sheet feeding unit 204 to the transfer position Nt. Note that components that are the same as the components described in FIGS. 15A and 15B are attached with the same reference numerals and the description thereof is omitted. The state of the roller unit is illustrated on the lower side of FIG. 27A. In the above, a case in which the roller unit is driven is indicated as ON, and a case in which the roller unit is stopped is indicates as OFF. The horizontal axis indicates the rear edge position of the sheet P. The roller unit is switched from a driving state to a driven state at a timing at which the rear edge of the sheet P reaches a predetermined position upstream of the abutment position in the conveyance direction between the pickup roller 210 and the sheet P. At such a timing, the conveyance force from the roller unit to the sheet P is lost and a back tension is generated, such that, instantaneously, the conveyance speed of the sheet P becomes slow. With the above, disadvantageously, there may be an effect on the image at the transfer position (a transfer nip portion) indicated by a star mark in FIG. 27A. Furthermore, as illustrated in FIG. 27B, when the rear edge of the sheet P passes the driven roller unit as well, since there will be no back tension from the roller unit, instantaneously, the conveyance speed of the sheet P becomes fast. In such a case as well, disadvantageously, there may be an effect on the image at the transfer position indicated by a star mark in FIG. 27B.

Control Block Diagram of Drive System

Figure 16:
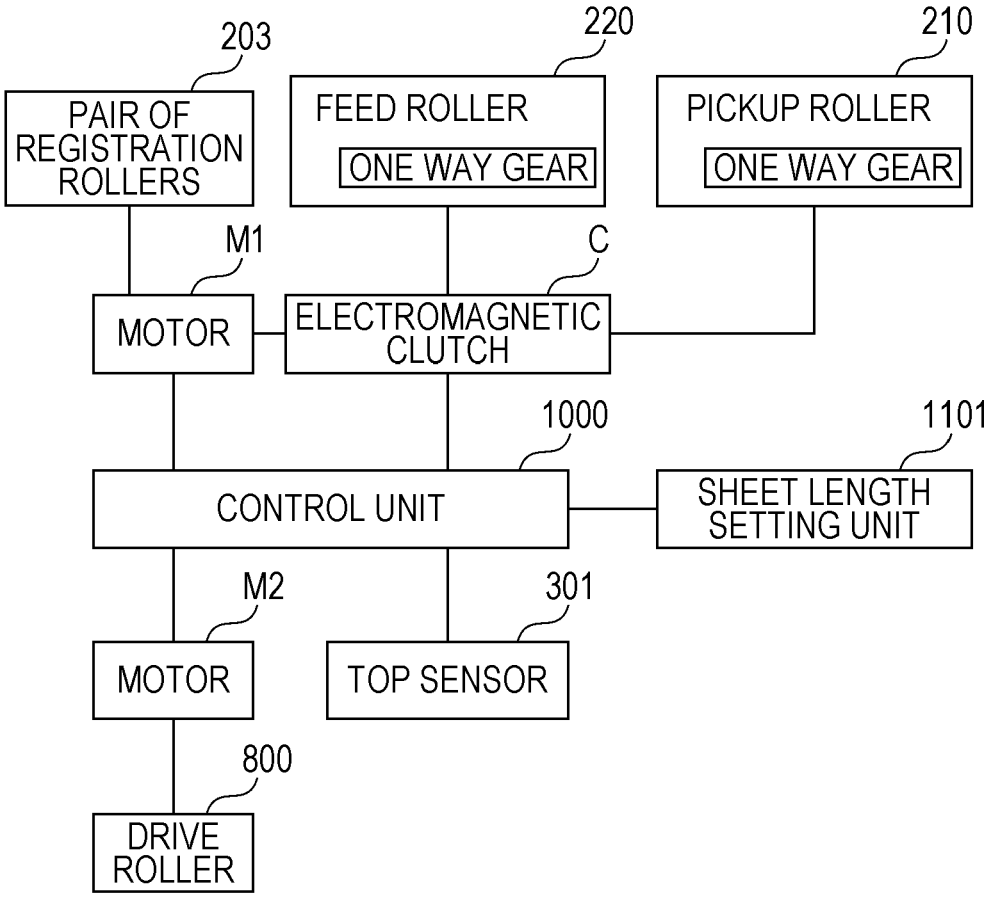
FIG. 16 is a block diagram related to a sheet feed control of the fifth and sixth embodiments.

FIG. 16 illustrates a control block diagram of the drive system of the present embodiment. A control unit 1000 of the printer 101 is connected to the motor M1, the motor M2, the top sensor 301, and the electromagnetic clutch C. Furthermore, the control unit 1000 controls each motor based on information of the length of the sheet P in the conveyance direction (hereinafter, also referred to as a sheet length) that has been set by a sheet length setting unit 1101 serving as a setting unit. The sheet length setting unit 1101 includes, for example, an operating unit (not shown) provided in the main body of the printer 101, and a sensor that measures the sheet length provided inside the sheet feeding cassette 240. The sensor provided inside the sheet feeding cassette 240 includes, for example, a sensor that detects a position of a regulating plate that regulates the rear edge of the sheet P accommodated in the sheet feeding cassette 240.

Sheet Feed Control

Figure 18:
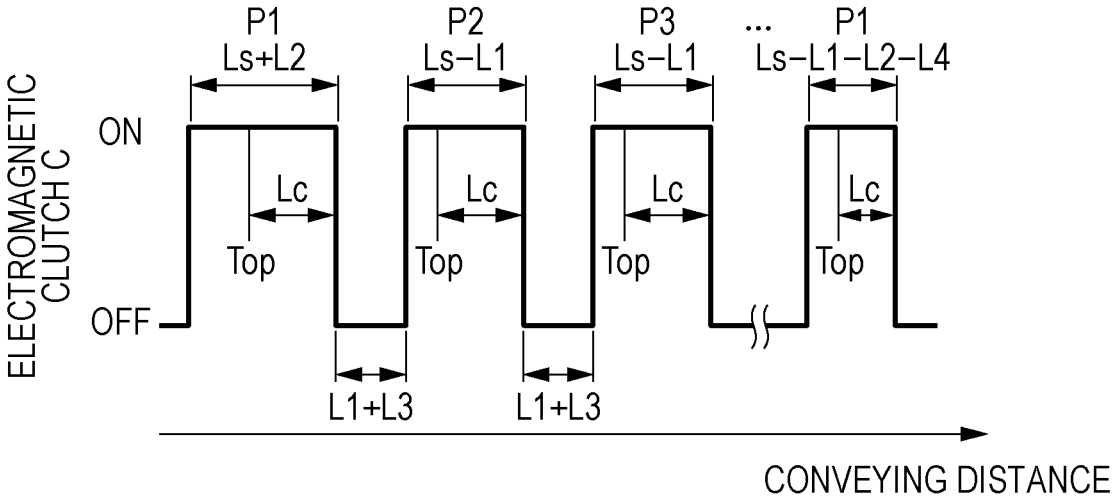
FIG. 18 is a diagram illustrating an operation of an electromagnetic clutch of the fifth embodiment.

Referring to FIGS. 17A-1 to 18, a state in which the sheet P is conveyed, and conveyance control of the sheet P according to the present embodiment adopting the configuration described above will be described. FIGS. 17A-1 to 17C-1 are schematic diagrams illustrating the states in which a single sheet P is fed in a case in which the sheets P are continuously fed. Components that are the same as the components described in FIGS. 15A and 15B and other figures are attached with the same reference numerals and the description thereof is omitted. Note that feeding a plurality of sheets P continuously, or continuously conveying a plurality of sheets P is, hereinafter, referred to as continuous sheet passing. FIG. 18 is a diagram illustrating the connection (turning on) and the disconnection (turning off) of the electromagnetic clutch C in relation to the conveying distance described later of the sheet P during continuous sheet passing, and the horizontal axis indicates the conveying distance. Note that in FIG. 18, the connection and disconnection of the electromagnetic clutch C related to the sheet P1 (the first sheet), the sheet P2 (the second sheet), the sheet P3 (the third sheet), . . . the last sheet P1 are described. Furthermore, when assuming that the $n^{th}$ sheet P is denoted as sheet Pn, "Top" in FIG. 18 indicates the timing at which a front edge Pfn of a sheet Pn is detected by the top sensor 301.

As illustrated in FIG. 17A-1, upon input of a print signal to the main body of the printer 101, the control unit 1000 rotates the motor M1, and connects (turns on) the electromagnetic clutch C. With the above, the roller unit rotates anticlockwise (FIG. 17A-1), and conveys the top sheet P inside the sheet feeding cassette 240 towards the pair of registration rollers 203. When the sheet P1 is fed, in a case in which the succeeding sheet P2 is fed together with the sheet P1 (hereinafter, also described as taken out together), the following operation is performed. In other words, the conveyed sheet P1 is separated into a single sheet with the feed roller 220 and the separation roller 230 described above and is conveyed to the pair of registration rollers 203, and the succeeding sheet P2 is not conveyed downstream of the separation nip portion N in the conveyance direction. Furthermore, the control unit 1000 rotates the intermediate transfer belt 600 of the intermediate transfer unit 500 by rotating the drive roller 800 through the motor M2; accordingly, image formation is started as required.

FIG. 17A-2 is a diagram illustrating the positional relationship between the members disposed on the conveyance path, and is a diagram that illustrates the electromagnetic clutch C being connected (turned on) and disconnected (turned off). Note that in the diagram illustrating the on/off of the electromagnetic clutch C, the horizontal axis indicates the position of the rear edge of the sheet P. Assume that the front edge of the sheet P1 in the conveyance direction is a front edge Pf1, and the rear edge is a rear edge Pr1. As illustrated in FIG. 17A-2, the sheet P1 is conveyed with the feed roller 220 and the pair of registration rollers 203 after the front edge Pf1 of the sheet P1 reaches the pair of registration rollers 203. After the front edge Pf1 of the sheet P1 reaches the pair of registration rollers 203, the top sensor 301 provided downstream of the pair of registration rollers 203 in the conveyance direction detects that the front edge Pf1 of the sheet P1 has reached the pair of registration rollers 203. Based on the signal input from the top sensor 301, the control unit 1000 increases or decreases the drive speed of the pair of registration rollers 203 until the sheet P1 is conveyed to the transfer position Nt, so that the image carried on the intermediate transfer belt 600 and the print start position of the sheet P1 coincide with each other. Furthermore, based on the signal input from the top sensor 301, the control unit 1000 conveys the sheet P1 a predetermined distance from when the front edge Pf1 of the sheet P1 has been detected by the top sensor 301 until the electromagnetic clutch C is disconnected (turned off). Note that the predetermined distance at which the sheet P1 is conveyed is referred to as a remaining conveying distance Lc. Note that the position of the rear edge Pr of the sheet P when the front edge Pf of the sheet P is detected by the top sensor 301 differs according to the length of the sheet P in the conveyance direction. Accordingly, the remaining conveying distance Lc also differs according to the length of the sheet P in the conveyance direction. In the present embodiment, for example, remaining conveying distances Lc of sheets P having predetermined lengths are obtained in advance, and the lengths of the sheets P in the conveyance direction and the remaining conveying distances Lc associated to each other are stored, for example, in a storage unit (not shown). In accordance with the length of the sheet P in the conveyance direction set by the sheet length setting unit 1101, the control unit 1000 reads out the remaining conveying distance Lc from the storage unit or the like and determines the remaining conveying distance Lc.

Note that the sheet length of the sheet P set by the sheet length setting unit 1101 is assumed as Ls. Furthermore, the distance along the conveyance path from the feed roller 220 to the transfer position Nt is assumed as a distance Lt. In a case in which sheet length Ls of the sheet P1 is shorter than distance Lt, the control unit 1000 disconnects (turns off) the electromagnetic clutch C before the rear edge Pr1 of the sheet P1 reaches the pickup roller 210. In the case in which sheet length Ls is shorter than distance Lt, the front edge Pf1 of the sheet P1 does not reach the transfer position Nt, before the rear edge Pr1 of the sheet P1 reaches the pickup roller 210. Accordingly, if the electromagnetic clutch C is disconnected before the rear edge Pr1 of the sheet P1 reaches the pickup roller 210, there is no effect on the image caused by the back tension. By performing the above control, the succeeding sheet P2 can be prevented from being fed. On the other hand, as described later, in a case in which sheet length Ls is equivalent to or longer than distance Lt, the control unit 1000 continues to connect (turn on) the electromagnetic clutch C until the rear edge Pr1 of the sheet P1 passes the feed roller 220. By performing the above control, occurrence of an image defect at the transfer position Nt caused by change in the conveyance speed of the sheet P1 can be suppressed when the back tension is generated at the separation nip portion N at the timing at which the electromagnetic clutch C is switched from being connected (turned on) to being disconnected (turned off). Furthermore, occurrence of an image defect at the transfer position Nt caused by the change in conveyance speed of the sheet P1 when the back tension is released at a timing at which the rear edge Pr1 of the sheet P1 passes through the separation nip portion N can be suppressed. The above back tension is created by torque limiter 2600 inside the separation roller 230.

In a case in which sheet length Ls is equivalent to or longer than distance Lt (Sheet P1)

Hereinafter, from FIG. 17B-1 and after, an operation in a case in which the sheet length Ls set by the sheet length setting unit 1101 is equivalent to or longer than distance Lt will be described. When the front edge Pf1 of the sheet P1 reaches the transfer position Nt, the toner image on the intermediate transfer belt 600 is transferred onto the sheet P1 with the secondary transfer roller 120, and the sheet P1 is conveyed downstream in the conveyance direction with the secondary transfer roller 120 and the drive roller 800. As illustrated in FIG. 17B-1, the electromagnetic clutch C is kept connected (kept on, the black thick arrow in the figure) even after the rear edge Pr1 of the sheet P1 has arrived at the pickup roller 210. In this respect, the above is different from the conventional configuration illustrated in FIG. 27A in which the electromagnetic clutch C is disconnected (turned off) at a timing at which the rear edge of the sheet P is positioned upstream of the pickup roller 210 in the conveyance direction, in other words, before passing the pickup roller 210. Note that distance L1 will be described later.

Subsequently, as illustrated in FIG. 17B-2, the control unit 1000 disconnects (turns off) the electromagnetic clutch C when the rear edge Pr1 of the sheet P1 is at a position (the black thick arrow in the figure) where the rear edge Pr1 of the sheet P1 is conveyed a predetermined distance from the front edge position Pf of the sheet P accommodated in the sheet feeding cassette 240. A distance along the conveyance path from the front edge position Pf of the sheet P accommodated in the sheet feeding cassette 240 to the rear edge Pr1 of the sheet P1 when the electromagnetic clutch C is disconnected is referred to as an extension distance L2. Extension refers to extending the time and the distance at which the electromagnetic clutch C is disconnected with respect to the timing and the conveying distance of the conventional control (FIG. 27A) in which the electromagnetic clutch C is disconnected before the rear edge of the sheet P passes the pickup roller 210. The control unit 1000 controls the extension distance L2 with the timing at which the front edge Pf1 of the sheet P1 is detected by the top sensor 301 and with the amount of rotation of the motor M1. Considering the ununiform conveyance caused due to the differences in the sheet length and in the diameters of the rollers, the backlash of the gear related to the drive, and the conditions of the sheet P and the surface of each roller, the extension distance L2 is set in advance so that the rear edge Pr1 of the sheet P1 reliably passes through the separation nip portion N. Furthermore, the set extension distance L2 is stored in, for example, a storage unit (not shown) in advance.

In the above, the pair of registration rollers 203 continues to convey the sheet P1 to the transfer position Nt, and in the transfer position Nt, transferring of the toner image is continued. Accordingly, as illustrated in FIG. 18, the distance at which the sheet P1 is conveyed by rotation of the roller unit when conveying the first sheet P1 during continuous sheet passing is the distance conveyed when the roller unit rotates a distance equivalent to the sum (Ls+L2) of the sheet length Ls and the extension distance L2. Note that the distance at which the sheet P1 is conveyed by rotation of the roller unit is, hereinafter, denoted as the conveying distance of the roller unit. Furthermore, as described above, the control of the timing at which the electromagnetic clutch C is disconnected (turned off) is performed by controlling the remaining conveying distance Lc based on the timing at which the front edge Pf1 of the sheet P1 has been detected by the top sensor 301. Accordingly, the present embodiment performs a control that excludes the influence of the stand-by position of the sheet P1 before being fed.

As described above, the following control is performed in a case of a sheet P that has a length in which the formation of an image is already started at the transfer position Nt when the rear edge Pr1 of the sheet P1 is passing through the separation nip portion N. In other words, driving of the feed roller 220 is continued until the rear edge Pr1 of the sheet P1 passes through the separation nip portion N. With the above, the image defect described above caused by the change in the back tension in the separation nip portion N can be prevented from being created.

Note that after the rear edge Pr1 of the preceding sheet P1 has passed the pickup roller 210, driving of the roller unit is continued and driving of the pickup roller 210 is continued. Accordingly, feeding of the succeeding sheet P2 is started at a timing (FIG. 17B-1) at which the rear edge Pr1 of the preceding sheet P1 passes the pickup roller 210. Accordingly, the feeding of the succeeding sheet P2 from the sheet feeding cassette 240 is already started at a timing illustrated in FIG. 17B-2 at which the electromagnetic clutch C is disconnected (turned off). The distance at which the sheet P2 is fed is as follows. That is, the sheet P2 is fed downstream of the front edge position Pf described above in the conveyance direction over a distance equivalent to the sum (L2+L1) of the extension distance L2 and a distance L1. Note that the distance L1 is, as illustrated in FIG. 17B-1, a distance from the position in which the pickup roller 210 is abutting against the sheet P to a front edge Pf2 of the succeeding sheet P2. The front edge of the sheet P before being fed may be, as illustrated in FIG. 17B-1, aligned at the front edge position Pf or may be positioned downstream of the front edge position Pf in the conveyance direction. Accordingly, distance L1 is a value that varies. As illustrated in FIGS. 17B-1 and 17B-2, distance L1 also is a portion where the sheet P1 and the sheet P2 overlap each other. Note that the overlapped portion of the sheet P1 and the sheet P2 maintains the distance L1 while being conveyed between FIG. 17B-1 and FIG. 17B-2.

Since there are cases in which the succeeding sheet P2 before being fed is taken out together with the preceding sheet P1, the position of the front edge Pf2 of the sheet P2 varies between the front edge position Pf of the sheet P accommodated inside the sheet feeding cassette 240 and the separation nip portion N. Accordingly, the position of the front edge Pf2 of the succeeding sheet P2 at the timing at which the electromagnetic clutch C of the preceding sheet P1 is disconnected (turned off) disadvantageously varies as well. However, regarding the succeeding sheet P2 as well, as described above, the electromagnetic clutch C is disconnected (turned off) at a timing at which the succeeding sheet P2 has been conveyed the remaining conveying distance Lc after the front edge Pf2 of the sheet P2 had been detected by the top sensor 301. Accordingly, it is possible to perform a control that is not affected by the variation in the position of the front edge Pf2 of the succeeding sheet P2. In other words, as illustrated in FIG. 18, the above variation is absorbed during the time between the timing at which the electromagnetic clutch C is connected and the timing (Top) at which the front edge Pf2 of the succeeding sheet P2 is detected.

After feeding of the first sheet P1 is ended and after the electromagnetic clutch C is disconnected (turned off), as described above, the conveyance of the preceding sheet P1 with the pair of registration rollers 203 is continued. Subsequently, as illustrated in FIG. 17C-1, at the point when the distance between the rear edge Pr1 of the preceding sheet P1 and the front edge Pf2 of the succeeding sheet P2 opens a predetermined distance, the electromagnetic clutch C is connected (turned on) again, and conveyance of the succeeding sheet P2 is started once more. Note that the predetermined distance between the rear edge Pr1 of the sheet P1 and the front edge Pf2 of the sheet P2 is referred to as an intersheet distance L3. The intersheet distance L3 is set to reliably detect that the rear edge Pr1 of the preceding sheet P1 has passed the top sensor 301 before the top sensor 301 detects the front edge Pf2 of the succeeding sheet P2. In other words, the intersheet distance L3 is set so that the top sensor 301 can detect the space between the sheets. Furthermore, the intersheet distance L3 is calculated by the control unit 1000 using the signals of the top sensor 301, the information from the sheet length setting unit 1101, and the amount of rotation of the motor M1 that rotates the pair of registration rollers 203. Accordingly, after the electromagnetic clutch C has been disconnected for the first sheet P1 and after the preceding sheet P1 is conveyed a distance equivalent to the sum (L1+L3) of the distance L1 and the intersheet distance L3, the electromagnetic clutch C is connected again and the conveyance of the succeeding sheet P2 is started once more. In other words, as illustrated in FIGS. 17C-1 and 18, the distance at which the sheet P1 is conveyed from when the electromagnetic clutch C is disconnected to when the electromagnetic clutch C is connected once more is equivalent to the sum of the distance L1 and the intersheet distance L3.

As described above, when the length of the sheet P in the conveyance direction is equivalent to or longer than the distance along the conveyance path from the separation nip portion N to the transfer position Nt, the control unit 1000 disconnects the electromagnetic clutch C after the rear edge of the sheet P has passed through the separation nip portion N. As for the first sheet P1, as illustrated in FIG. 18, the conveying distance at which the electromagnetic clutch C is connected (turned on) is Ls+L2. Meanwhile, from when the electromagnetic clutch C is disconnected for the first sheet P1 until the electromagnetic clutch C is connected for the second sheet P2, in other words, the section in which the electromagnetic clutch is disconnected (turned off) is, when described with the conveying distance, L1+L3.

(Sheet P2)

Similar to the first sheet P1, after a front edge position Pf2 has been detected with the top sensor 301, the conveyance speed of the second sheet P2 is increased or decreased with the pair of registration rollers 203 until reaching the transfer position Nt so that the toner image on the intermediate transfer belt 600 and the print start position of the sheet P2 coincide with each other. Subsequently, the sheet P2 is conveyed while having the toner image transferred thereto at the transfer position Nt. In a case in which there is a sheet P3 that is to be printed after the sheet P2, similar to the first sheet P1, until a rear edge Pr2 of the sheet P2 passes through the separation nip portion N, that is, while the sheet P2 is conveyed the extension distance L2, the electromagnetic clutch C for the sheet P2 is kept connected (turned on). Accordingly, as illustrated in FIG. 18, the conveying distance of the second sheet P2 from when the electromagnetic clutch C is connected (turned on) once again until the electromagnetic clutch C is disconnected (turned off) is the following value. That is, the value is obtained by subtracting the distance precedingly conveyed in the first sheet P1 feeding operation, that is, the sum of the distance L2 and distance L1, from the sheet length Ls, and adding the distance L2. Accordingly, Ls−(L2+L1)+L2=Ls−L1. Furthermore, similar to the control for the first sheet P1, the control of the timing at which the electromagnetic clutch C is disconnected (turned off) is performed by controlling the remaining conveying distance Lc based on the information of the detection of the front edge Pf2 of the sheet P2 by the top sensor 301.

Subsequently, as long as the continuous sheet passing operation continues, regarding the third sheet P and the sheets P fed after the third sheet P3, the control unit 1000 connects (turns on) the electromagnetic clutch C while the sheet P is conveyed over Ls-L1. Furthermore, while the preceding sheet P is conveyed over L1+L3, the control unit 1000 disconnects (turns off) the electromagnetic clutch C. As described above, while the operation of continuously conveying the sheets P continues, the control unit 1000 repeats connecting (turning on) and disconnecting (tuning off) the electromagnetic clutch C based on the distances described above. As long as the above operation continues, the feed roller 220 is driven until the rear edge Pr of the conveyed sheet P passes through the separation nip portion N. Accordingly, the image defect caused by the change in the back tension in the separation nip portion N can be suppressed from occurring.

As described above and as illustrated in FIG. 18, regarding the second sheet P2 and the sheets P after the second sheet P2, the conveying distance at which the electromagnetic clutch C is connected (turned on) is Ls−L1. Meanwhile, regarding the second sheet P2 and the sheets P after the second sheet P2, from when the electromagnetic clutch C is disconnected until the electromagnetic clutch C is connected for the succeeding sheet P, in other words, the section in which the electromagnetic clutch is disconnected (turned off) is, similar to the sheet P1 when expressed by the conveying distance, L1+L3.

(Last Sheet P1)

When the electromagnetic clutch C is connected (turned on) until the last sheet P1 of the continuous sheet passing passes through the separation nip portion N, the printing operation disadvantageously ends in a state in which the next sheet P is nipped in the separation nip portion N. In the above state, when the user draws out the sheet feeding cassette 240, the sheet P nipped in the separation nip portion N may become damaged. Accordingly, regarding the last sheet P1 in a single job, as illustrated in FIG. 17C-2, the electromagnetic clutch C is disconnected (turned off) before a rear edge Pr1 of the last sheet P1 passes the pickup roller 210. Accordingly, as illustrated in FIGS. 17C-2 and 18, the conveying distance while the electromagnetic clutch C for the last sheet P1 is connected (turned on) is the following value. That is, the value is (Ls−L1−L2−L4) that is a value obtained by subtracting the distance precedingly conveyed in the sheet feeding operation of the sheet P immediately before, that is, the sum of the distance L2 and the distance L1, from the length Ls of the sheet P1 (Ls−(L2+L1)) and further, subtracting a distance L4. Note that distance L4 is a distance from the rear edge Pr1 of the last sheet P1 at the timing at which the electromagnetic clutch C is disconnected (turned off) to the front edge position Pf of the sheet P accommodated inside the sheet feeding cassette 240.

The timing at which the electromagnetic clutch C is disconnected (turned off) for the last sheet P1 is set considering the ununiform conveyance caused due to the difference in the length of the sheet P1 and in the diameters of the rollers, the backlash of the gear related to the drive, the conditions of the sheets and surface of each roller, and the like. In other words, the distance L4 is set in advance so that, even if there are differences in the sheet length and the diameters of the rollers, the drive of the pickup roller 210 is disconnected (turned off) before the rear edge Pr1 of the sheet P1 passes the pickup roller 210, and the distance L4 is stored in, for example, a storage unit. Furthermore, regarding the last sheet P1 as well, the control of the timing at which the electromagnetic clutch C is disconnected (turned off) is performed by controlling the remaining conveying distance Lc based on the timing at which the front edge Pf1 of the sheet P1 has been detected by the top sensor 301. As described above and as illustrated in FIG. 18, as for the last sheet P1, the conveying distance at which the electromagnetic clutch C is connected (turned on) is Ls−L1−L2−L4.

Sheet Feed Control

Figure 19:
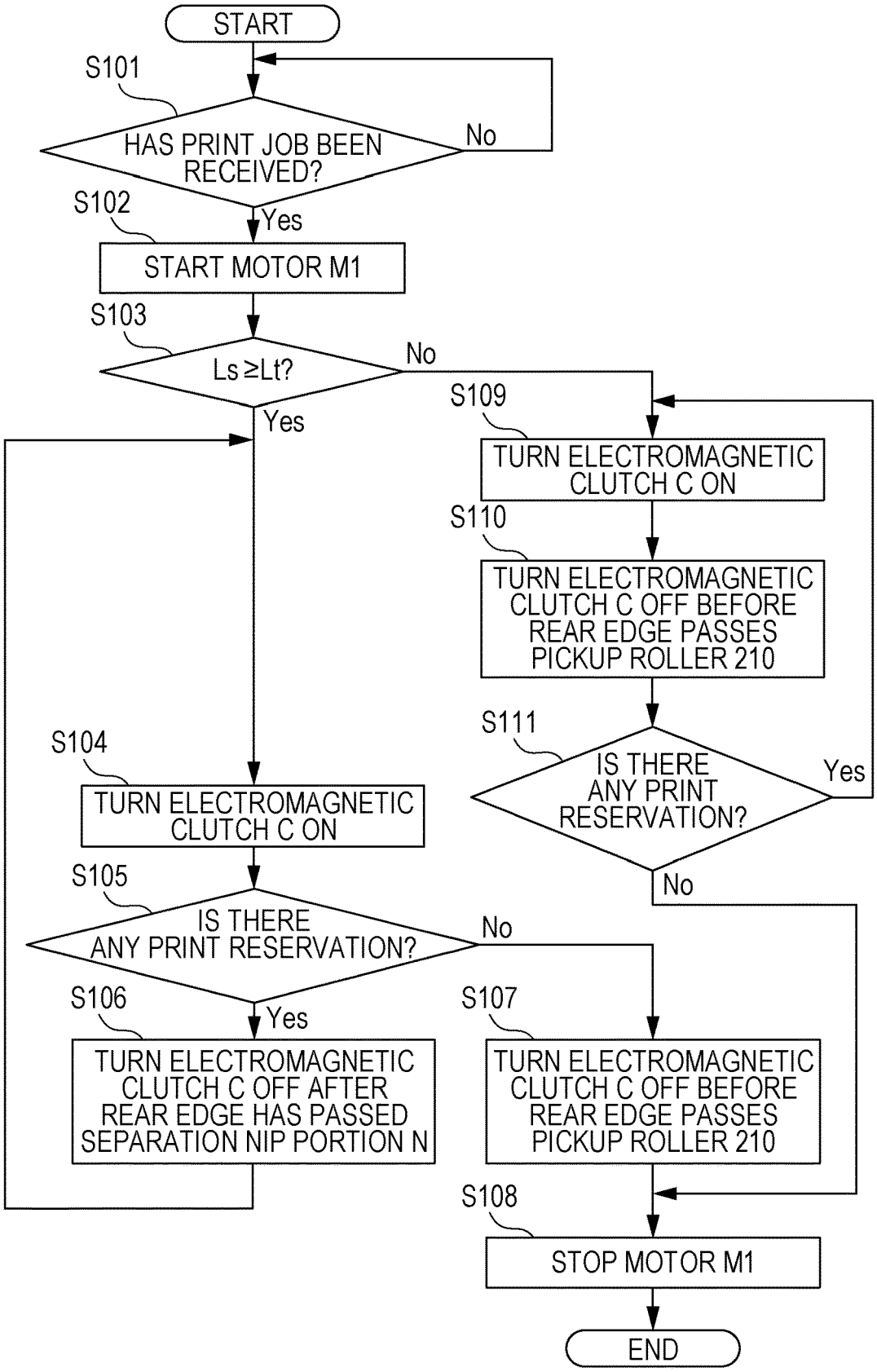
FIG. 19 is a flowchart illustrating a sheet feed control of the fifth embodiment.

FIG. 19 is a flowchart describing the sheet feed control performed by the control unit 1000. In step (hereinafter, referred to as S) 101, the control unit 1000 determines whether a print job has been received. In S101, in a case in which the control unit 1000 determines that a print job has not been received, the process is returned to S101, and in a case in which it is determined that a print job has been received, the process is proceeded to S102. In S102, the control unit 1000 starts to drive the motor M1. In S103, the control unit 1000 determines whether the sheet length Ls is equivalent to or longer than the distance Lt. In a case in which in S103, the control unit 1000 determines that the sheet length Ls is equivalent to or longer than the distance Lt (Ls≥Lt), the process is proceeded to S104. In a case in which in S103, the control unit 1000 determines that the sheet length Ls is shorter than the distance Lt (Ls<Lt), the process is proceeded to S109.

In S104, the control unit 1000 turns the electromagnetic clutch C on. In S105, the control unit 1000 determines whether there is a next print reservation. In S105, in a case in which the control unit 1000 determines that there is a next print reservation, the process is proceeded to S106, and in a case in which it is determined that there is no print reservation coming next, the process is proceeded to S107. In S106, the control unit 1000 turns the electromagnetic clutch C off after the rear edge of the sheet P has passed through the separation nip portion N, and the process is returned to S104. In S104, the control unit 1000 turns the electromagnetic clutch C on at the timing described in FIG. 18 to feed the next sheet P. In S107, the control unit 1000 turns the electromagnetic clutch C off before the rear edge of the last sheet P1 passes the pickup roller 210. In S108, the control unit 1000 stops the drive of the motor M1 and the process is ended.

In S109, the control unit 1000 turns the electromagnetic clutch C on. In S110, the control unit 1000 turns the electromagnetic clutch C off before the rear edge of the sheet P passes the pickup roller 210. In S111, the control unit 1000 determines whether there is a next print reservation. In S111, in a case in which the control unit 1000 determines that there is a next print reservation, the process is returned to S109, and in a case in which it is determined that there is no print reservation coming next, the process is proceeded to S108.

As described above, in the present embodiment, the driving state of the roller unit is maintained until the rear edges Pr of the sheets P except for the last sheet P1 during continuous sheet passing pass the separation nip portion N. With the above, the image defect at the transfer portion Nt caused by the change in the conveyance speed of the sheet P occurring at the moment when the roller unit changes from the driving state to the driven state and at the moment when the sheet P is released from the back tension generated in the separation nip portion N between the driven feed roller 220 and the separation roller 230. Furthermore, since there will be no need to perform a complex speed control of the conveyance roller, a sensor or the like to detect the type and the state of the sheet that is conveyed does not need to be added. Furthermore, in a case in which the conveyance roller downstream of the roller unit in the conveyance direction is not needed due to, for example, miniaturization of the printer 101 making the distance between the roller unit and the transfer position Nt shorter, the sheet can be conveyed to the transfer position Nt in a stable manner. As described above, the present embodiment is capable of reducing the image defect, which is caused by the back tension generated at the feeding unit, with a simple configuration and control regardless of the type and state of the sheet.

Sixth Embodiment

In the fifth embodiment, the electromagnetic clutch C is disconnected (turned off) before the rear edge Pr1 of the sheet P1 passes the pickup roller 210. By so doing, a state in which the sheet P succeeding the last sheet P1 during continuous sheet passing being nipped in the separation nip portion N and the sheet P being damaged when the sheet feeding cassette 240 is drawn out from the main body of the printer 101 can be prevented. Meanwhile, an image defect may be disadvantageously created in the last sheet P1 due to the change in the back tension at the separation nip portion N. Accordingly, in the present embodiment, the electromagnetic clutch C is connected (turned on) until the rear edge Pr1 of the last sheet P1 as well passes the separation nip portion N. With the above, the image defect due to the change in the back tension of the separation nip portion N is suppressed in the last sheet P1 as well during continuous sheet passing. Furthermore, in the present embodiment, the separation nip portion N is separated (released) immediately after drawing out of the sheet feeding cassette 240 from the main body of the printer 101 is started. With the above, even when the sheet feeding cassette 240 is drawn out in a state in which the sheet P succeeding the last sheet P1 is nipped in the separation nip portion N, damage to the sheet P can be prevented from occurring. A specific configuration of the above will be described below.

State During Feeding

Figure 20A:
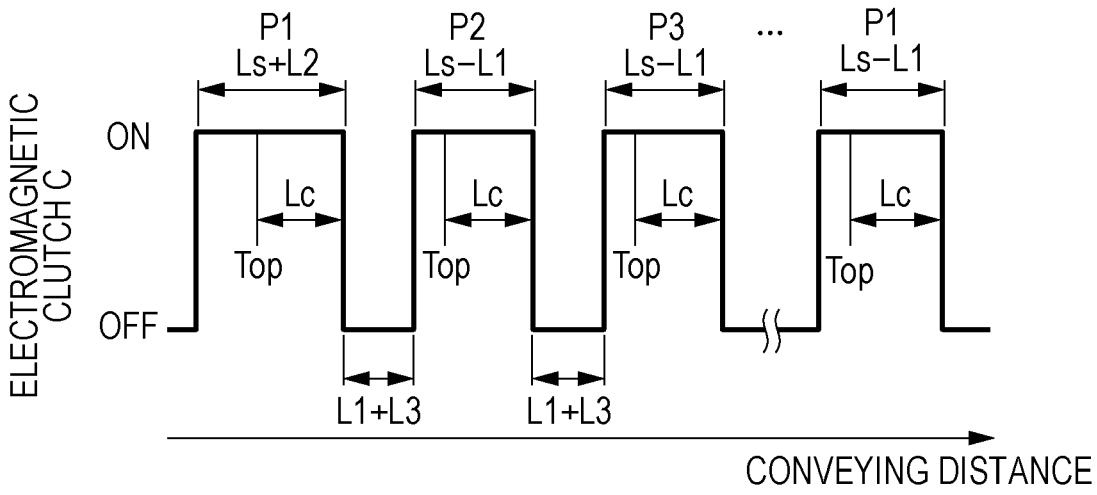
FIGS. 20A and 20B are diagrams illustrating an operation of an electromagnetic clutch of the sixth embodiment.
Figure 20B:
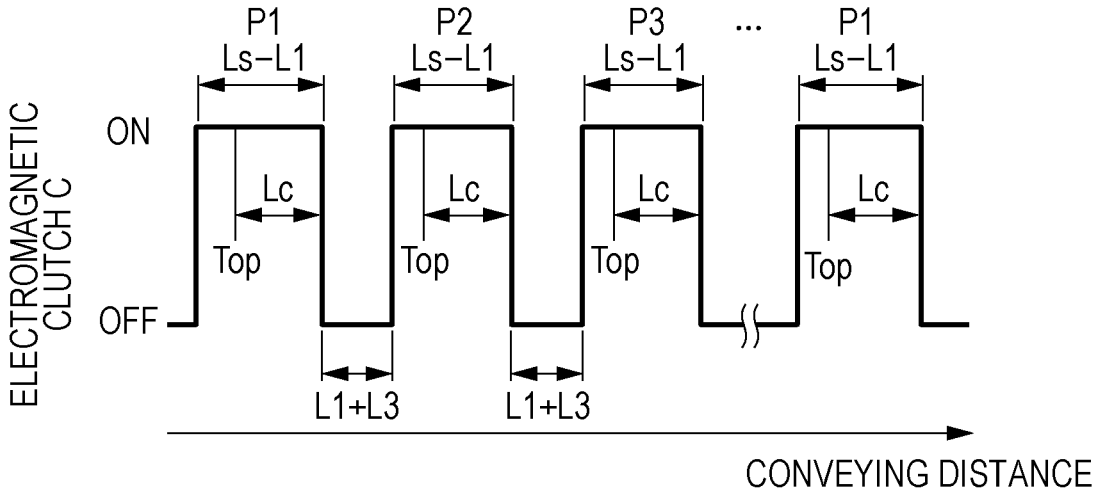

FIGS. 20A and 20B are diagrams illustrating the connection (turning on) and disconnection (turning off) of the electromagnetic clutch C related to the conveying distance of the sheet P during continuous sheet passing of the present embodiment. Note that description of contents that are the same as those described in FIG. 18 are omitted. FIG. 20A is a diagram illustrating a state of the electromagnetic clutch C and the conveying distance when the feeding of the first sheet P1 accommodated inside the sheet feeding cassette 240 has been started. FIG. 20B is a diagram illustrating a state of the electromagnetic clutch C and the conveying distance when feeding is started while the front edge Pf1 of the first sheet P1 is nipped in the separation nip portion N. In FIG. 20A and FIG. 20B, the conveying distance while the electromagnetic clutch C is connected (turned on) is different since the stand-by position of the first sheet P1 before being fed is different during the job. In either case, since the control is started based on the signal (Top) output when the front edge Pf1 of the first sheet P1 is detected by the top sensor 301, the control of the second sheet and after is the same. A major difference in the control compared with the control in the fifth embodiment illustrated in FIG. 18 is that the electromagnetic clutch C is kept connected (kept on) until the rear edge Pr1 of the last sheet P1 passes the separation nip portion N. Accordingly, each conveying distance illustrated in FIGS. 20A and 20B while the electromagnetic clutch C of the last sheet P1 is connected is, similar to that of the sheet P immediately before, Ls−L1. Accordingly, the image defect due to the change in the back tension of the separation nip portion N can be suppressed in the last sheet P1 as well during continuous sheet passing. Note that in the present embodiment, regarding the last sheet P1, the conveying distance while the electromagnetic clutch C is connected is set to Ls−L1. Accordingly, the front edge Pf1 of the first sheet P1 when the next job is instructed is, as illustrated in FIGS. 17B-2 and 17C-1, positioned downstream of the front edge position Pf in the conveyance direction. Accordingly, as illustrated in FIG. 20B, the conveying distance while the electromagnetic clutch C for the first sheet P1 of the next job is connected is, similar to that of the second sheet P2 and after, Ls−L1.

Configuration of Separation Nip Portion

Figure 21:
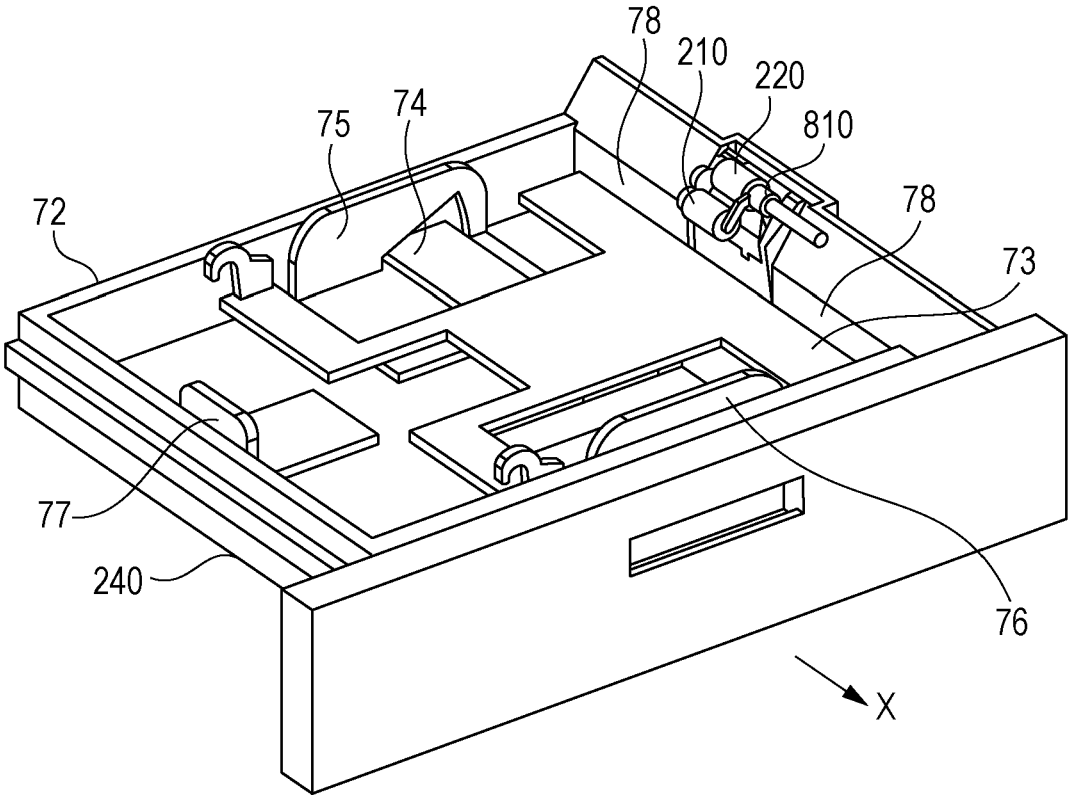
FIG. 21 is a perspective view illustrating a sheet feeding cassette of the sixth embodiment.
Figure 22A:
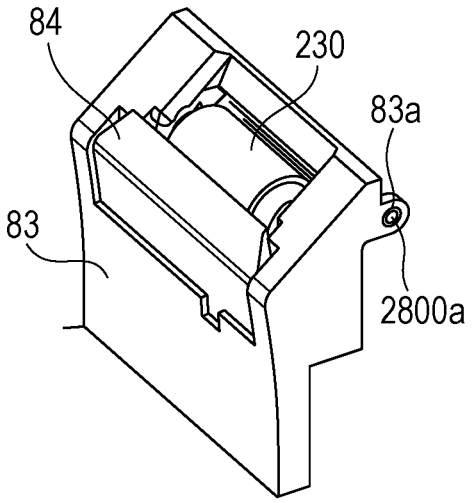
FIGS. 22A to 22C are diagrams illustrating a separation roller unit of the sixth embodiment.
Figure 22B:
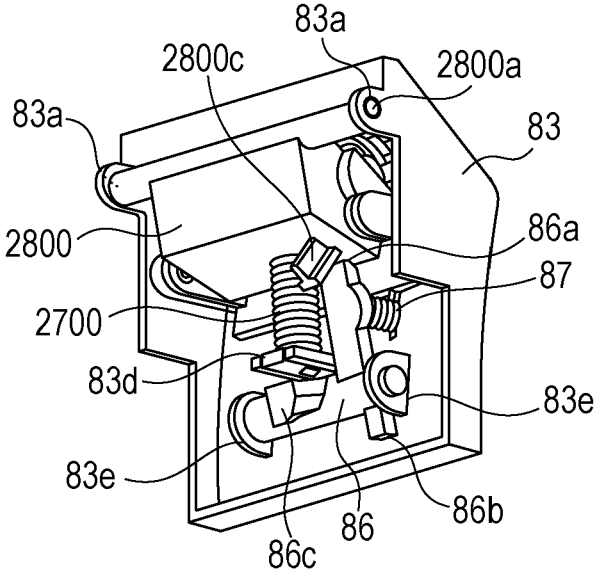
Figure 22C:
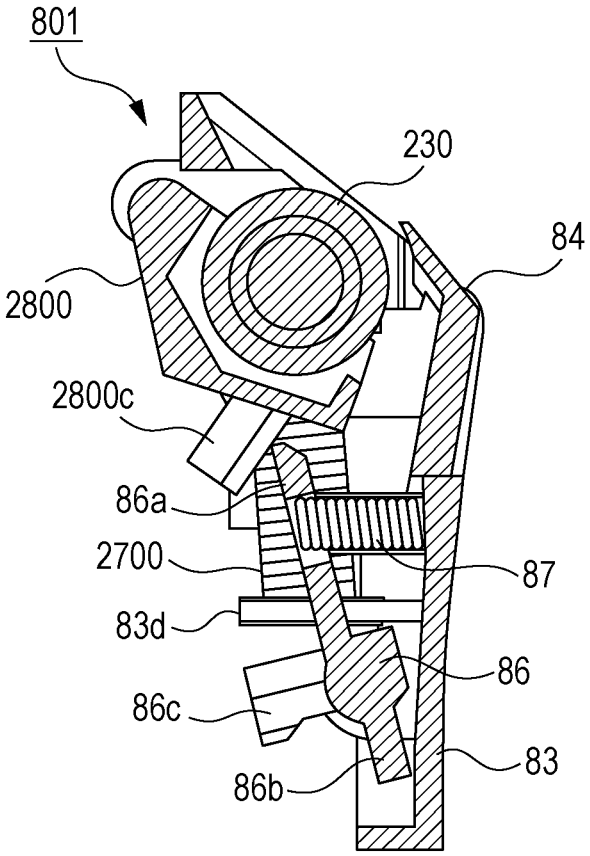

A configuration that releases the separation nip portion N when the sheet feeding cassette 240 is drawn out will be described next with reference to FIGS. 21 to 23D. FIG. 21 is a perspective view illustrating an appearance of the sheet feeding cassette 240, and a drawing out direction of the sheet feeding cassette 240 is an X-direction in FIG. 21. FIGS. 22A to 22C are outside drawings and a cross-sectional view of a separation roller unit 810 provided in a detachable manner with respect to the sheet feeding cassette 240. FIGS. 23A to 23D are diagrams illustrating appearances of a cassette rail 900 that supports the sheet feeding cassette 240 with respect to the main body of the printer 101.

As illustrated in FIG. 21, the sheet feeding cassette 240 includes a sheet feeding cassette base 72, a sheet stacking plate 73, a lifter 74, side regulating plates 75 and 76, a rear edge regulating plate 77, and the separation roller unit 810. As described above, the pickup roller 210 and the feed roller 220 are rotatably supported by the main body of the printer 101, and a drive is transmitted thereto through the electromagnetic clutch C from the motor M1 provided in the main body of the printer 101. The sheet feeding cassette base 72 serves as a housing, and sheets P are stacked on the sheet stacking plate 73. The side regulating plates 75 and 76 are members that restrict the position of the stacked sheets P in the width direction that is a direction orthogonal to the conveyance direction of the stacked sheet P. The side regulating plates 75 and 76 can be moved to match the width of the sheet P through operation of the user, and by abutting the side regulating plates 75 and 76 against the lateral sides of the stacked sheets P, the positions of the two edge portions of the sheet P in the width direction are aligned with the side regulating plates 75 and 76.

The rear edge regulating plate 77 is a member that regulates the positions of the rear edges of the stacked sheets P. The rear edge regulating plate 77 can be moved from the rear of the sheet feeding cassette base 72 towards the separation nip portion N through the operation of the user. By abutting the rear edge regulating plate 77 against the rear edges of the stacked sheets P, the rear edges of the sheets P are aligned by the rear edge regulating plate 77. In so doing, upon movement of the rear edge regulating plate 77, the sheets P are moved in the sheet feeding direction, and the front edges of the sheets P are aligned on the front edge surface 78 of the sheet feeding cassette base 72, that is, the front edges of the sheets P are aligned at the front edge position Pf described above. As described above, the separation roller unit 810 is detachably supported with respect to the sheet feeding cassette 240 such that the separation roller unit 810 can be replaced when the surface of the separation roller 230 becomes worn out.

FIGS. 22A to 22C are schematic diagrams illustrating a configuration of the separation roller unit 810. The separation roller unit 810 includes the separation roller 230, the holder 2800, a cover 83, a nip guide 84, the compression spring 2700, a separation lever 86, and a separation spring 87. As described above, both ends of a shaft portion 2600*a* of the separation roller 230 are supported by grooves of the holder 2800 so that a D-shaped cut surface of the D-shaped shaft portion 2600*a* (FIG. 15B) does not revolve. There is a rotation center 2800*a* that serves as shaft-like projections at both ends of the holder 2800 and that engage with holes 83*a* of the cover 83 such that the holder 2800 supporting the separation roller 230 is supported to be capable of swinging with respect to the cover 83. Furthermore, a projection 2800*c* is formed on the underside of the holder 2800, and the compression spring 2700 that biases the holder 2800 upwards is disposed on the underside of the holder 2800. A lower end of the compression spring 2700 is engaged with and supported by a rib 83*d* of the cover 83. The separation lever 86 is disposed below the rib 83*d* of the cover 83. Both ends of the separation lever 86 are supported by ribs 83*e* of the cover 83 in a pivotal manner. The separation lever 86 is provided with a front edge 86*a*, a rotation stopping rib 86*b*, and an abutment rib 86*c*. The separation spring 87 that biases the separation lever 86 is disposed on the cover 83 side of the separation lever 86.

FIG. 22C illustrates a cross-section of the separation roller unit 810 at a time when the sheet feeding cassette 240 has been drawn out from the main body of the printer 101. Biased by the separation spring 87, the separation lever 86 is pivoted and the rotation stopping rib 86*b* is abutted against the cover 83 to stop the separation lever 86. Furthermore, the front edge 86*a* of the separation lever 86 abuts against the projection 2800*c* of the holder 2800, and countering the biasing force of the compression spring 2700, maintains a state in which the holder 2800 is pivoted at a predetermined angle with respect to the cover 83. In the above state, the separation roller 230 supported by the holder 2800 is retracted below the upper surface portion of the holder 2800.

Figure 23A:
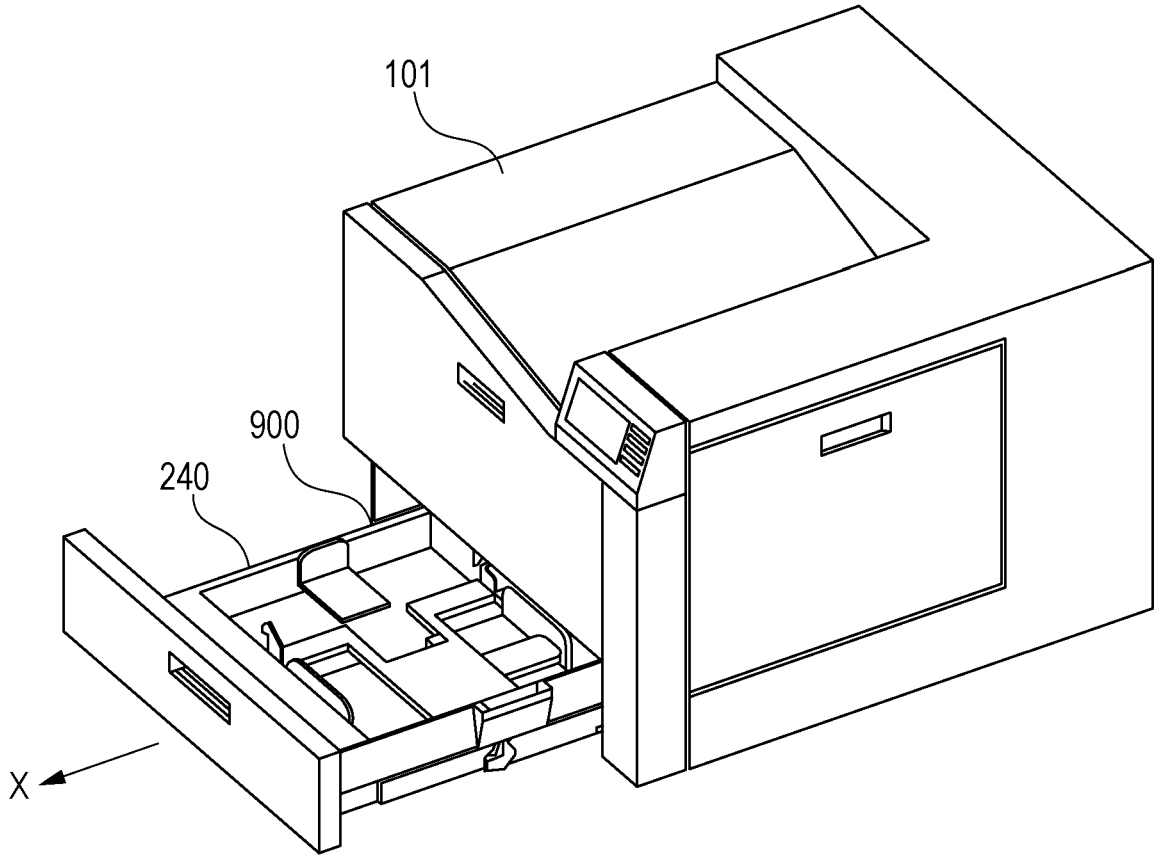
FIGS. 23A to 23D are diagrams illustrating cassette rails of the sixth embodiment.
Figure 23B:
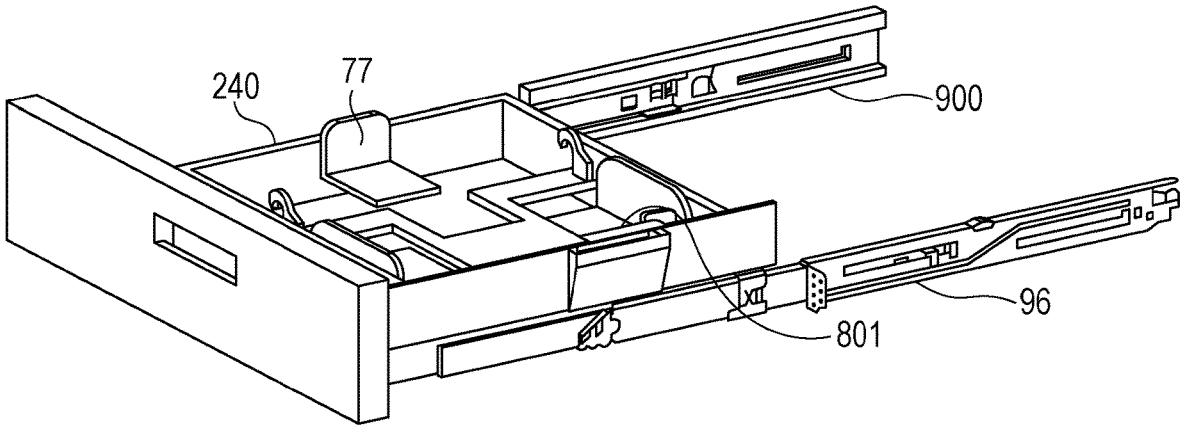
Figure 23C:
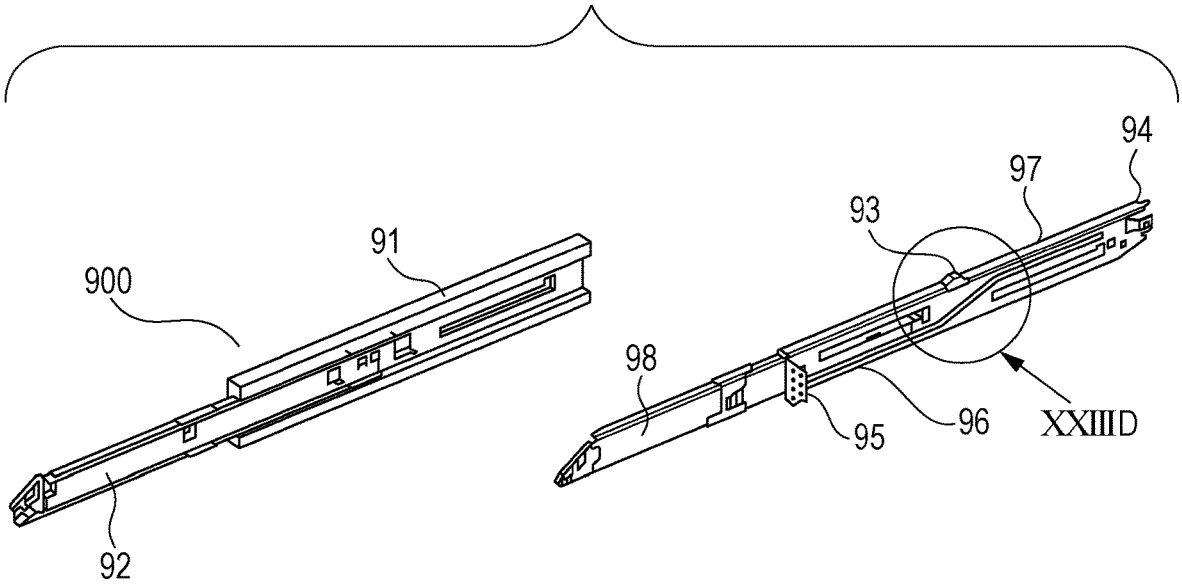
Figure 23D:
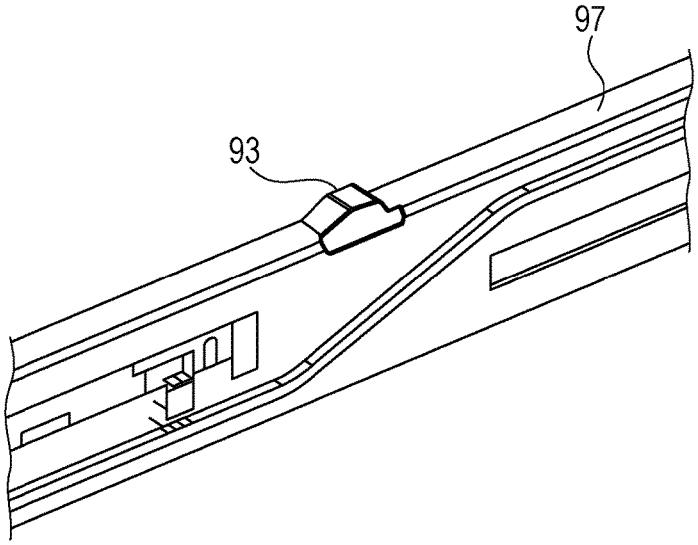

As illustrated in FIGS. 23A to 23D, the sheet feeding cassette 240 is detached through the cassette rail 900 that is supported by the main body of the printer 101. FIG. 23A is a perspective view illustrating the sheet feeding cassette 240 of the present embodiment that has been drawn out from the main body of the printer 101. FIG. 23B is a perspective view illustrating the sheet feeding cassette 240 and the cassette rails in a state in which the sheet feeding cassette 240 of the present embodiment has been drawn out from the main body of the printer 101. FIG. 23C is a perspective view illustrating the cassette rail 900 and a cassette rail 96 in a state in which the sheet feeding cassette 240 of the present embodiment has been drawn out from the main body of the printer 101. FIG. 23D is an enlarged view of the round framed portion in FIG. 23C.

The cassette rail 900 is a member that guides the sheet feeding cassette 240 mounted in and dismounted from the printer 101. The printer 101 is provided with the cassette rail 900 disposed on the rear edge regulating plate 77 side of the sheet feeding cassette 240, and the cassette rail 96 disposed on the separation roller unit 810 side of the cassette rail 900. The cassette rails 900 and 96 include outer cassette rails 91 and 97, respectively, that are fixed to the main body of the printer 101, and inner rails 92 and 98, respectively, that are drawn out together with the sheet feeding cassette 240. The outer cassette rails 91 and 97 and the inner rails 92 and 98 form extending and contracting rails. A trapezoidal projection 93 that protrudes upwards is provided at the middle of the outer cassette rail 97 of the cassette rail 96. FIG. 23D is a diagram of the round framed portion in FIG. 23C illustrating the vicinity of the trapezoidal projection 93 in an enlarged manner. Furthermore, a rear end portion 94 that is one of the end portions of the outer cassette rail 97 is inserted in the body frame (not shown) of the main body of the printer 101, and a tab 95 that is the other end portion is fastened and fixed to the body frame with a screw.

Release Operation of Separation Nip Portion N

Figure 24A:
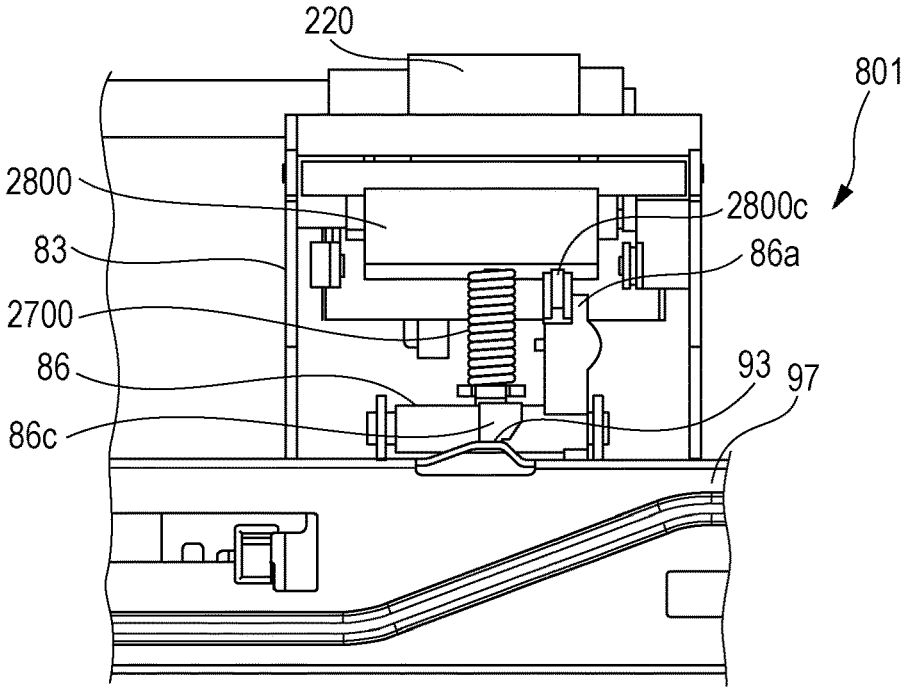
FIGS. 24A and 24B are diagrams illustrating a mounted state of the sheet feeding cassette of the sixth embodiment.
Figure 24B:
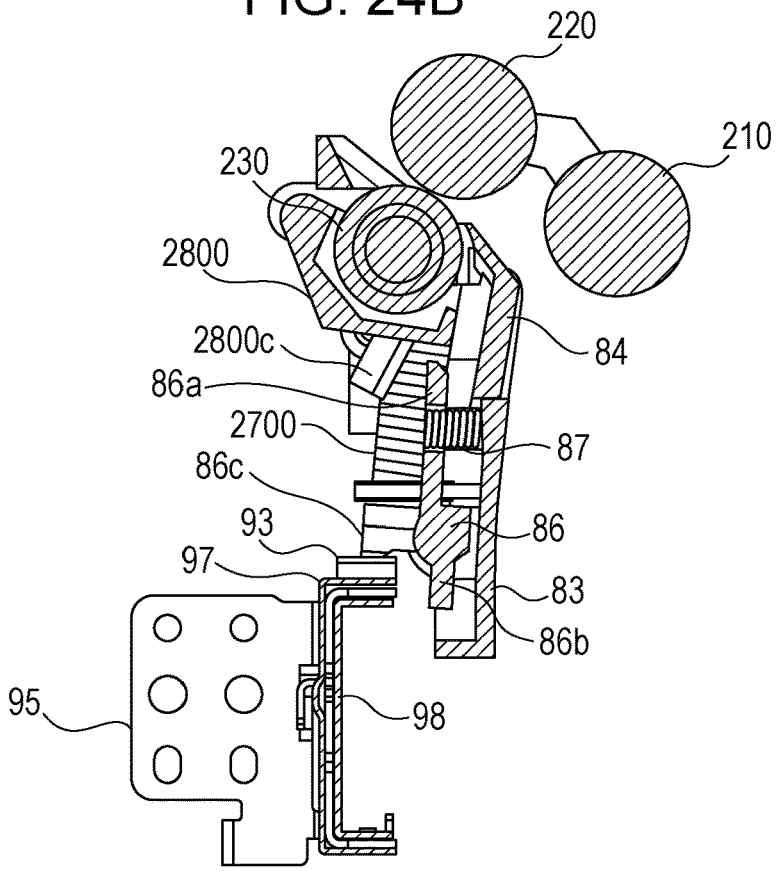
Figure 25A:
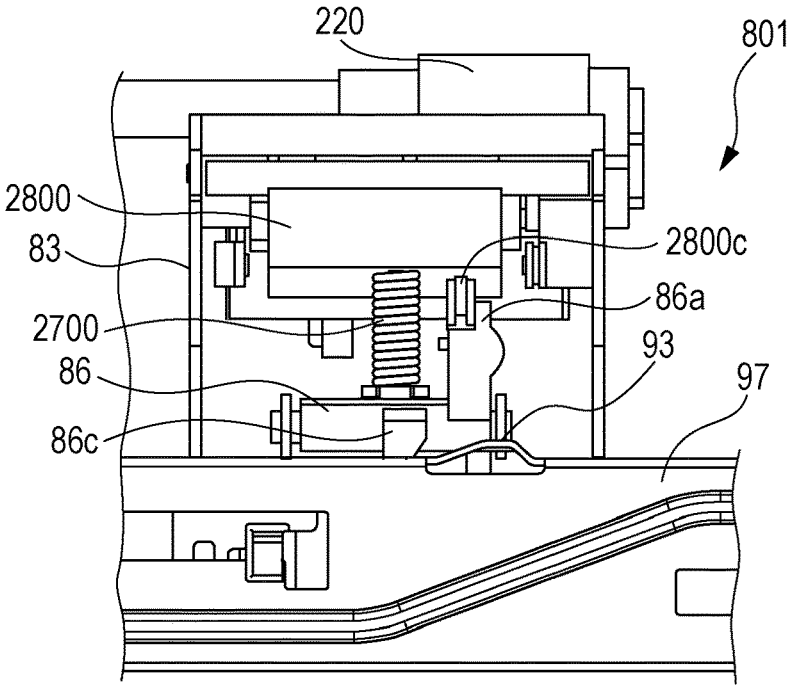
FIGS. 25A and 25B are diagrams illustrating the sheet feeding cassette of the sixth embodiment at the start of a drawing-out operation.
Figure 25B:
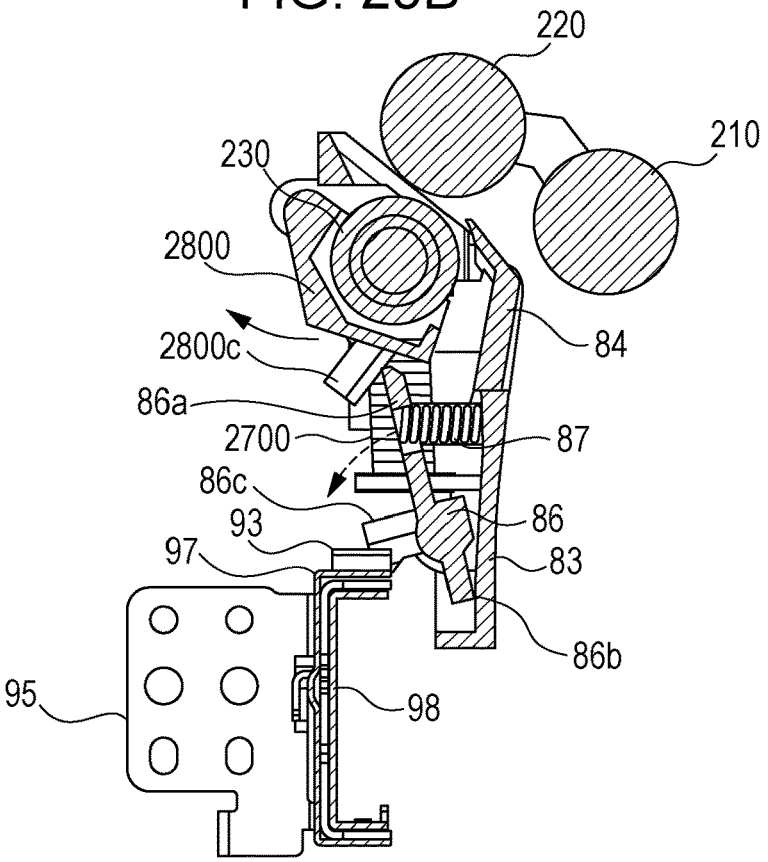

Using the configuration described above, an operation in which the separation nip portion N is released when the sheet feeding cassette 240 is drawn out will be described with reference to FIGS. 24A to 25B. FIG. 24A is a side view, viewed from the right side (the right side in FIG. 15A) of the main body of the printer 101, illustrating the positional relationship between the separation roller unit 810 and the outer cassette rail 97 when the sheet feeding cassette 240 is mounted in the main body of the printer 101. FIG. 24B is a cross-sectional view viewed from the rear side (the right side in FIG. 23A) of the main body of the printer 101. FIGS. 25A and 25B are a side view and a cross-sectional view, respectively, immediately after the sheet feeding cassette 240 has started to be drawn out from the main body of the printer 101, and FIGS. 25A and 25B corresponds to FIGS. 24A and 24B, respectively. As illustrated in FIGS. 24A and 24B, in a state in which the sheet feeding cassette 240 is mounted in the main body of the printer 101, the abutment rib 86*c* of the separation lever 86 abuts against the top of the trapezoidal projection 93 of the outer cassette rail 97, and the separation lever 86 is pivoted to a position where the front edge 86*a* of the separation lever 86 is set apart from the holder 2800. In such a state, the separation roller 230 abuts against the feed roller 220 with the spring pressure of the compression spring 2700.

From the above state, when the sheet feeding cassette 240 is drawn out from the main body of the printer 101, as illustrated in FIGS. 25A and 25B, the abutment rib 86*c* of the separation lever 86 is separated from the top of the trapezoidal projection 93 of the outer cassette rail 97. With the above, the separation lever 86 being biased by the separation spring 87 is pivoted anticlockwise (in the direction of the broken arrow in FIG. 25B). Furthermore, the front edge 86*a* of the separation lever 86 abuts against the projection 2800*c* of the holder 2800, and countering the biasing force of the compression spring 2700, pivots the holder 2800 clockwise (in the direction of the solid line arrow in FIG. 25B) with respect to the cover 83. In so doing, the separation holder 230 supported by the holder 2800 retracts below the upper surface portion of the holder 2800 and is separated from the feed roller 220.

Sheet Feed Control

Figure 26:
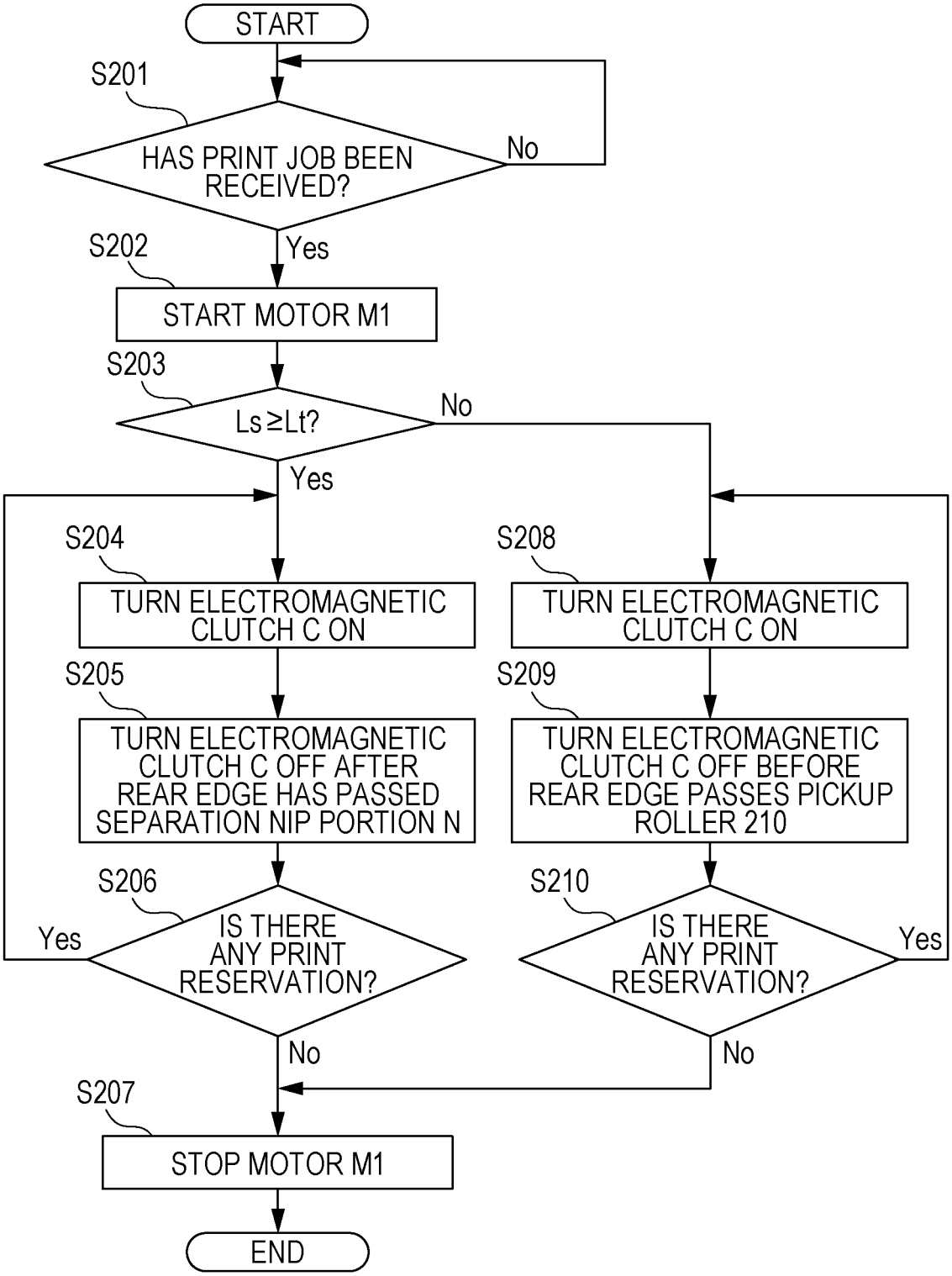
FIG. 26 is a flowchart illustrating a sheet feed control of the sixth embodiment.

FIG. 26 is a flowchart describing the sheet feed control performed by the control unit 1000. The process in S201 to S204 is similar to that of S101 to S104 in FIG. 19, and description thereof is omitted. After turning the electromagnetic clutch C on, in S205, the control unit 1000 turns the electromagnetic clutch C off after the rear edge of the sheet P has passed through the separation nip portion N. In S206, the control unit 1000 determines whether there is a next print reservation. In S206, in a case in which the control unit 1000 determines that there is a next print reservation, the process is returned to S204, and in a case in which it is determined that there is no print reservation coming next, the process is proceeded to S207. The process in S207 to S210 is similar to that of S108 to S111, and description thereof is omitted.

By employing the configuration described above, the separation nip portion N is released immediately after the sheet feeding cassette 240 is started to be drawn out from the main body of the printer 101; accordingly, even in a state in which the sheet P is nipped in the separation nip portion N, damage to the sheet P can be averted.

Accordingly, the electromagnetic clutch C can be disconnected (turned off) for all of the sheets fed from the sheet feeding cassette 240 after the rear edge of the sheet P has passed through the separation nip portion N; accordingly, the image defect caused by the change in the back tension of the separation nip portion N can be suppressed.

In the sixth embodiment described above, an example of a measure in which the separation nip portion N is released to prevent the sheet P from being damaged when the sheet feeding cassette 240 is drawn out has been described; however, not limited to the above, for example, a retard roller that is rotationally driven in a direction opposite to the rotation of the feed roller 220 may be used to return the sheet P nipped in the separation nip portion N to the sheet feeding cassette 240 after continuous sheet passing has ended. Furthermore, as a configuration that returns the sheet P to the sheet feeding cassette 240, the sheet P nipped in the separation nip portion N may be returned inside the sheet feeding cassette 240 with driving of a feed roller 220 that can be rotated in a reverse manner after continuous sheet passing. Other than the above, the feed roller 220 itself may be provided inside the sheet feeding cassette 240 such that the sheet feeding cassette 240 is drawn out together with the separation nip portion N.

As described above, the present embodiment is capable of reducing the image defect, which is caused by the back tension generated at the feeding unit, with a simple configuration and control regardless of the type and state of the sheet.

In the fifth and sixth embodiments described above, a configuration provided with the feed roller 220 and the separation roller 230 has been described. However, not limited to the above configuration, a retard roller that is driven with the motor M1 in a direction opposite to the sheet P feeding direction may be provided instead of the separation roller 230. Furthermore, a separating pad that forms a nip portion together with the feed roller 220 may be provided instead of the separation roller 230.

Note that a configuration in which the on/off of the feed roller and the on/off of the pickup roller can be controlled independently may be employed. In such a case, even when the feed roller is kept on until the rear edge of the sheet P passes through the separation nip portion N, the pickup roller does not have to be turned on. Accordingly, when being conveyed, the succeeding sheet will not protrude downstream in the conveyance direction with respect to the separation nip portion N.

While the present invention has been described with reference to embodiments, it is to be understood that the invention is not limited to the disclosed embodiments. The scope of the following claims is to be accorded the broadest interpretation to encompass all such modifications and equivalent structures and functions.

What is claimed is:

1. An image forming apparatus comprising:

a feeding member configured to feed a recording material placed on a tray;

a conveying member configured to convey the recording material that has been fed by the feeding member;

a separation member configured to form a nip portion together with the conveying member and separate a plurality of the recording materials from each other at the nip portion;

an image forming unit configured to form an image on the recording material at an image forming position downstream of the conveying member in a conveyance direction of recording material;

a setting unit configured to set a length of the recording material in the conveyance direction;

a drive unit configured to drive at least the conveying member; and a control unit configured to control driving of the conveying member, wherein, in a case where the length of the recording material set by the setting unit is greater than or equal to a predetermined length, the control unit is configured to stop the conveying member driven by the drive unit after a rear edge of the recording material passes the nip portion, and wherein, in a case where the length of the recording material set by the setting unit is smaller than the predetermined length, the control unit is configured to stop the conveying member driven by the drive unit before the rear edge of the recording material passes the nip portion.

2. The image forming apparatus according to claim 1, wherein the drive unit is configured to drive the feeding member and the conveying member, and includes a motor and an electromagnetic clutch configured to transmit or block driving force from the motor to the feeding member and the conveying member.

3. The image forming apparatus according to claim 2, wherein the feeding member and the conveying member each includes a one way gear.

4. The image forming apparatus according to claim 1, wherein the tray is capable of being drawn out from and mounted in the image forming apparatus, wherein, in a state in which the tray is mounted in the image forming apparatus, the separation member abuts against the conveying member and forms the nip portion, and wherein, in a case in which drawing out of the tray from the image forming apparatus is started, the separation member becomes separated from the conveying member and releases the nip portion.

5. The image forming apparatus according to claim 4, wherein the feeding member and the conveying member each includes a one way gear.

6. The image forming apparatus according to claim 1, wherein the predetermined length is a distance between a position of the nip portion and the image forming position along a conveyance path.

7. The image forming apparatus according to claim 6, wherein the drive unit is configured to drive the feeding member and the conveying member, and includes a motor and an electromagnetic clutch configured to transmit or block driving force from the motor to the feeding member and the conveying member.

8. The image forming apparatus according to claim 7, wherein, in a case where the length of the recording material set by the setting unit is greater than or equal to the predetermined length, the control unit is configured to control the electromagnetic clutch to block the driving force from the motor to the feeding member and the conveying member after a rear edge of the recording material passes the nip portion, and wherein, in a case where the length of the recording material set by the setting unit is smaller than the predetermined length, the control unit is configured to control the electromagnetic clutch to block the driving force from the motor to the feeding member and the conveying member before the rear edge of the recording material passes the nip portion.

* * * * *